US007815418B2

(12) United States Patent
Suzuki et al.

(10) Patent No.: US 7,815,418 B2
(45) Date of Patent: Oct. 19, 2010

(54) SHROUD AND ROTARY VANE WHEEL OF PROPELLER FAN AND PROPELLER FAN

(75) Inventors: Atsushi Suzuki, Aichi (JP); Tetsuo Tominaga, Hyogo (JP); Tsuyoshi Eguchi, Hyogo (JP); Kazuyuki Kamiya, Aichi (JP); Asuka Soya, Aichi (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 1236 days.

(21) Appl. No.: 11/363,535

(22) Filed: Feb. 28, 2006

(65) Prior Publication Data

US 2007/0031250 A1 Feb. 8, 2007

(30) Foreign Application Priority Data

Aug. 3, 2005 (JP) ..... 2005-225856
Aug. 3, 2005 (JP) ..... 2005-225858
Aug. 3, 2005 (JP) ..... 2005-225859

(51) Int. Cl.
*F04D 29/38* (2006.01)

(52) U.S. Cl. ..... 415/222; 416/228; 416/244 R; 416/236 R; 416/236 A; 416/238; 416/DIG. 2

(58) Field of Classification Search ..... 415/220, 415/222; 416/182, 183, 185, 188, 228, 244 R, 416/235, 236 R, 236 A, 237, 238, 243, DIG. 2
See application file for complete search history.

(56) References Cited

U.S. PATENT DOCUMENTS 2,099,229 A * 11/1937 Possenheim ..... 416/228
3,294,175 A * 12/1966 Bodner ..... 416/235
4,128,363 A * 12/1978 Fujikake et al. ..... 416/236 A
4,265,596 A * 5/1981 Katagiri et al. ..... 416/236 A (Continued)

FOREIGN PATENT DOCUMENTS

JP 56-85594 A 7/1981

(Continued)

OTHER PUBLICATIONS

Chinese Office Action dated May 16, 2008, issued in corresponding Chinese Patent Application No. 2006100597982.*

(Continued)

*Primary Examiner*—Christopher Verdier
(74) *Attorney, Agent, or Firm*—Westerman, Hattori, Daniels & Adrian, LLP

(57) ABSTRACT

A shroud includes a body portion 5B, a mount 7 positioned at a center of the body portion 5B and supporting rotary vane wheel driver 6, and multiple support beams 10 radially extending from the mount 7 and joining the mount 7 and the body portion 5B, where each of the support beams 10 becomes thicker from an upstream side of a flow direction of air toward a downstream side thereof, and an edge portion 10ti of each of the support beams 10 on the downstream side of the flow direction of the air discharged by the rotary vane wheel 8 is oriented in a direction parallel to a rotation axis of the rotary vane wheel 8, and the edge portion on the upstream side is oriented in a direction opposite to a rotation direction of the rotary vane wheel 8.

6 Claims, 29 Drawing Sheets

U.S. PATENT DOCUMENTS

| | | | | |
|---|---|---|---|---|
| 4,959,571 | A | 9/1990 | Yasumoto et al. | |
| 5,603,607 | A * | 2/1997 | Kondo et al. | 416/228 |
| 6,241,474 | B1 * | 6/2001 | Alizadeh et al. | 416/DIG. 2 |
| 6,595,744 | B2 * | 7/2003 | Van Houten | 416/228 |
| 7,273,354 | B2 * | 9/2007 | Spaggiari | 416/238 |
| 2003/0231956 | A1 * | 12/2003 | Lin | 415/222 |
| 2004/0091359 | A1 * | 5/2004 | Vanmoor | 416/228 |
| 2004/0161338 | A1 * | 8/2004 | Hsieh | 416/236 A |

FOREIGN PATENT DOCUMENTS

| | | | |
|---|---|---|---|
| JP | 57-186096 | A | 11/1982 |
| JP | 58-67999 | A | 4/1983 |
| JP | 62-18398 | U | 2/1987 |
| JP | 63-92099 | U | 6/1988 |
| JP | 5-321893 | | 12/1993 |
| JP | 7-167095 | | 7/1995 |
| JP | 8-170599 | | 7/1996 |
| JP | 8-189497 | A | 7/1996 |
| JP | 9-191924 | A | 7/1997 |
| JP | 10-89289 | A | 4/1998 |
| JP | 10-227295 | | 8/1998 |
| JP | 11-264396 | A | 9/1999 |
| JP | 2001-73995 | A | 3/2001 |
| JP | 2001-182690 | A | 7/2001 |
| JP | 2002-47937 | | 2/2002 |
| JP | 2003-106296 | A | 4/2003 |
| JP | 2003-254293 | A | 9/2003 |
| JP | 3467815 | | 11/2003 |
| JP | 2004-218513 | | 8/2004 |
| JP | 2004-278370 | A | 10/2004 |
| JP | 2005-90336 | | 4/2005 |
| JP | 2005-105865 | A | 4/2005 |

OTHER PUBLICATIONS

Japanese Office Action dated Jan. 26, 2010, issued in corresponding Japanese Patent Application No. 2005-225856 (With Translation).
Japanese Office Action dated Jan. 26, 2010, issued in corresponding Japanese Patent Application No. 2005-225858 ( With Translation).
Japanese Office Action dated Jan. 26, 2010, issued in corresponding Japanese Patent Application No. 2005-225859 (With Translation).

* cited by examiner

SHROUD AND ROTARY VANE WHEEL OF PROPELLER FAN AND PROPELLER FAN

CROSS-REFERENCE TO RELATED APPLICATIONS

This application is based upon and claims the benefit of priority from Japanese Patent Application Nos. 2005-225856, 2005-225858 and 2005-225859 filed Aug. 3, 2005, the entire contents of which are incorporated herein by reference.

BACKGROUND OF THE INVENTION

1. Field of the Invention

The present invention relates to a shroud and a rotary vane wheel of a propeller fan and the propeller fan.

2. Description of the Related Art

A vehicle is provided with a propeller fan for cooling heat exchangers such as a radiator and a condenser of an air conditioner. Japanese Patent Application Laid-Open No. 2002-47937 discloses a stay for supporting a boss of the fan to a shroud. To achieve high fan efficiency and low noise when running at low speed, this stay is of an aspect ratio>1, has a longitudinal direction of its section oriented toward a direction of an airflow generated by driving the fan and also has a cavity provided on a side of a negative pressure of the stay generated by the airflow when the vehicle is running at high speed.

An engine room of the vehicle hardly has space because it has not only an engine as a power source of the vehicle but also its accessories mounted therein. For this reason, the propeller fan for cooling the radiator and condenser is limited as to its dimension in the airflow direction. Consequently, the space between the fan and the stay becomes small, and noise when operating the propeller fan becomes high. The stay is required to have strength for supporting the fan and driving means (an electric motor for instance) of the fan. This strength cannot be secured, however, if the stay is rendered thin in an attempt to reduce the noise when operating the propeller fan. Such a problem is not considered in Japanese Patent Application Laid-Open No. 2002-47937. Therefore, there is room for improvement in a conventional technology disclosed in Japanese Patent Application Laid-Open No. 2002-47937 as to reducing the noise while limiting the dimension in the airflow direction and further securing support strength of the stay (first problem).

As for the propeller fan for cooling the radiator and condenser for the vehicle, it is placed in a narrow engine room and required to be further lightweight, and so there is a strong request for compactification regarding a depth dimension in a flow direction of cooling wind. If the depth dimension is thus reduced, however, a cross-section of a cooling wind channel of the shroud of the propeller fan changes drastically because the radiator on an upstream side is rectangular while an air sucking path of the propeller fan is round. For this reason, there is a problem that an uneven drift is formed in a circumferential direction of the propeller fan (rotary vane wheel) to generate unpleasant BPF (Blade Passing Frequency) noise.

The radiator and condenser as cooling subjects are small-size and require high heat exchange performance so that ventilation resistance thereof is high. For this reason, the propeller fan is driven under a condition of a high static pressure difference reverse to an adverse wind direction. In this case, there is a problem that the flow on a propeller plane of the rotary vane wheel breaks away so as to increase input and the noise under the same air volume condition.

As for these problems, there is a known technology described in Japanese Patent Application Laid-Open No. 7-167095 regarding a conventional propeller fan. The conventional propeller fan (electric fan) is the electric fan rotatively driven by the electric motor, which comprises a boss portion for rotating by receiving a driving force of the electric motor and 9 to 13 blades (blade portion) placed around the boss portion circumferentially apart from the boss portion. The blade is characterized by being a forward swept vane of which angle of advance overlooking a vane edge from a vane root is 35 to 45 degrees.

However, the propeller fan described in Japanese Patent Application Laid-Open No. 7-167095 is not sufficient as to noise reduction performance (second problem).

As the rotary vane wheel provided to the conventional propeller fan has multiple blades in general, the multiple blades rotate on rotating the rotary vane wheel by the driving means such as the electric motor so as to let the air flow by means of these blades. Thus, these blades for blowing air by letting the air flow are fixed on a hub of the rotary vane wheel. The hub is provided to connect the blades to an axis of the driving means and transfer rotation of the axis of the driving means to the blades. For that reason, the hub does not contribute to air blowing so much. Therefore, there is a conventional rotary vane wheel wherein occupancy of the blades in the rotary vane wheel is enlarged to increase a sent air volume so as to improve air blowing performance. In Japanese Patent Application Laid-Open No. 2004-218513 for instance, a joint of the blades and the hub is extended inward in a radial direction centering on a rotation axis of the hub to increase length of the blades in the radial direction. It is thereby possible to improve the occupancy of the blades in the case of axially viewing the rotary vane wheel so as to increase the sent air volume and improve the air blowing performance.

In the case of the above-mentioned rotary vane wheel, however, there is little difference in that the hub does not contribute to improvement in the air blowing performance so much because the hub is basically in a cylindrical shape. As with the above-mentioned rotary vane wheel, the blades are extended inward in the radial direction centering on a rotation axis of the hub so that a radial step is generated on an end of the upstream side of the hub in the circumferential direction of the rotation axis. Therefore, there is a possibility that the airflow may be disturbed in this part. In the case where the airflow is thus disturbed, the efficiency lowers and so there is a possibility that the air blowing performance may lower and the noise may be easily generated (third problem).

SUMMARY OF THE INVENTION

Objects of the present invention are at least to solve the above-mentioned problems.

According to one aspect of the present invention, a shroud of a propeller fan includes a body portion for accommodating a rotary vane wheel of the propeller fan; a mount positioned at a center of the body portion for supporting rotary vane wheel driving means for driving the rotary vane wheel; and multiple support beams radially extending from the mount for joining the mount and the body portion, wherein each of the support beams becomes thicker from an upstream side of a flow direction of air discharged by the rotary vane wheel toward a downstream side thereof, an edge portion of each of the support beams on the downstream side of the flow direction of the air discharged by the rotary vane wheel is oriented in a direction parallel to a rotation axis of the rotary vane wheel, and the edge portion of each of the support beams on the upstream side of the flow direction of the air discharged by the rotary vane wheel is oriented in a direction opposite to a rotation direction of the rotary vane wheel.

According to another aspect of the present invention, a propeller fan includes the shroud of the propeller fan; rotary vane wheel driving means attached on a mount; and a rotary vane wheel driven by the rotary vane wheel driving means.

According to still another aspect of the present invention, a propeller fan includes a rotary vane wheel having multiple blade portions arranged on a hub portion which is a rotor; a motor for rotating the rotary vane wheel; and a shroud having a motor holding portion for holding the motor, wherein, a ratio $H/D_F$ between an axial width H and a diameter $D_F$ at an end of the rotary vane wheel is in a range of $H/D_F \leqq 0.12$, a ratio $D_m/D_F$ between a diameter $D_m$ of the hub portion and the diameter $D_F$ at the end of the blade portion is in the range of $D_m/D_F \leqq 0.50$, a ratio P/C between a circumferential pitch P and a chord length C of the blade portion is in the range of $1.0<P/C<1.2$, and an outer circumferential side of the blade portion is swept forward in a rotation direction of the rotary vane wheel.

According to still another aspect of the present invention, a rotary vane wheel includes multiple blade portions; and a hub having the multiple blade portions provided on its outer circumferential surface, wherein, in the case where, of both edges of the outer circumferential surface in an axial direction of a rotation axis of the hub, one edge is an upstream side end portion and the other edge is a downstream side end portion, the outer circumferential surface has an inclined portion inclined against the rotation axis in a direction to be further away from the rotation axis as directed from the upstream side end portion to the downstream side end portion and a parallel portion formed along the rotation axis, the parallel portion is formed between a connecting portion connecting the blade portion to the outer circumferential surface and the downstream side end portion, and positioned more inward in a radial direction of the rotation axis than an extended inclined portion which is a virtual extended portion of the inclined portion continued from the inclined portion between the connecting portion and the downstream side end portion.

According to still another aspect of the present invention, a propeller fan includes the rotary vane wheel; driving means for supporting the rotary vane wheel rotatably centering on the rotation axis; and a shroud for placing the rotary vane wheel therein and fixing the driving means.

DETAILED DESCRIPTION OF THE PREFERRED EMBODIMENTS

Hereunder, the present invention will be described in detail by referring to the attached drawings. The present invention will not be limited by embodiments described below. Components of the following embodiments include the ones easily assumable by those in the art or the ones which are substantially the same.

First Embodiment

While a propeller fan according to a first embodiment is not limited as to its application, it is suitable in particular to the propeller fan which is limited as to a dimension in a rotation axis direction of a rotary vane wheel provided to the propeller fan. Such a propeller fan can be exemplified by the one used for cooling of a heat exchanger mounted on a vehicle, such as a passenger car or a truck.

Figure 1:
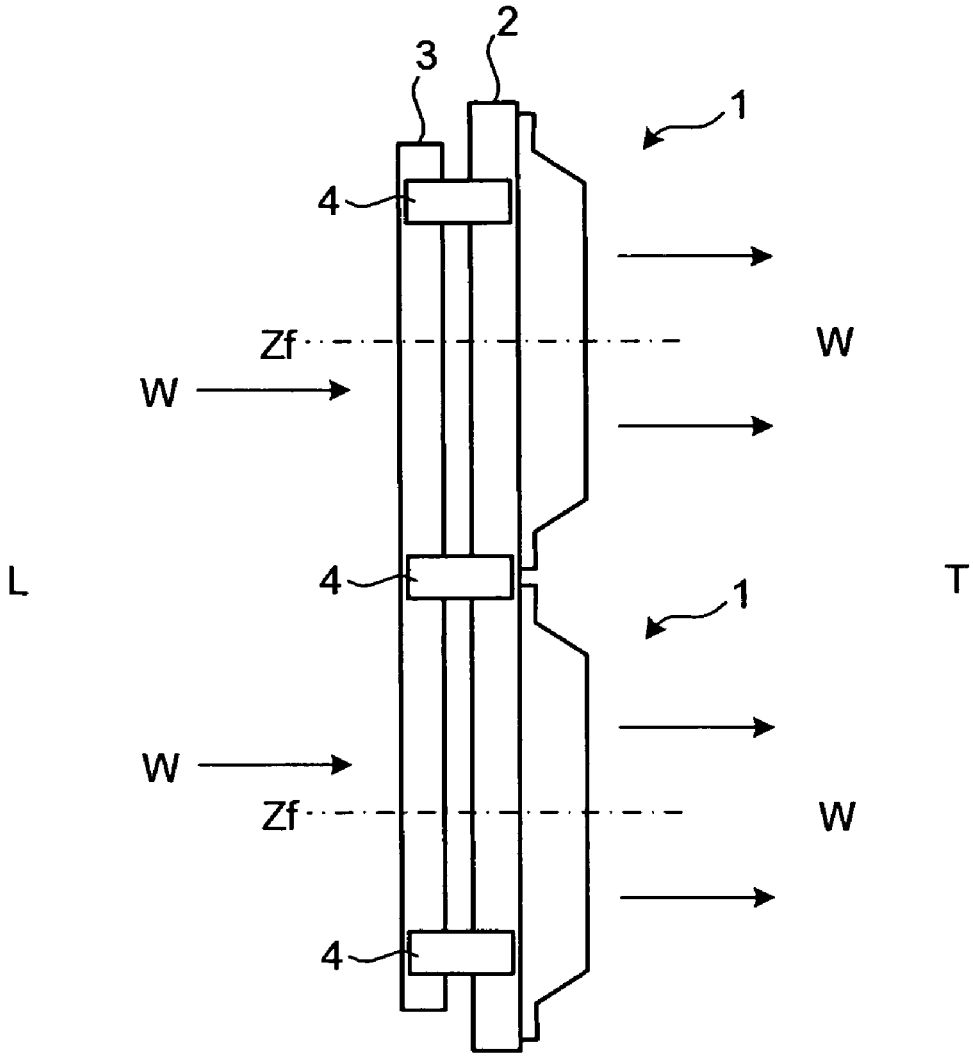
FIG. 1 is a plan view showing an example of a propeller fan according to a first embodiment of the present invention mounted on a heat exchanger for a vehicle.

FIG. 1 is a plan view showing an example of the propeller fan according to the first embodiment mounted on the heat exchanger for a vehicle. A description will be given by using FIG. 1 as to an example of mounting a propeller fan 1 according to the first embodiment. The propeller fan 1 is used for cooling of the heat exchanger such as a radiator 2 or a condenser 3. In general, a vehicle such as a passenger car or a truck has the radiator 2 for cooling engine coolant or the condenser 3 of an air conditioner mounted at a front of the vehicle (hereafter, vehicle front) L in its traveling direction, and leads a driving wind thereto so as to cool the coolant and condense a refrigerant.

In the example shown in FIG. 1, the condenser 3 and the radiator 2 are united by fasteners 4. The propeller fan 1 according to the first embodiment is mounted on the radiator 2, and its position is at a rear of the vehicle (hereafter, vehicle rear) T side in its traveling direction. Thus, this example has the condenser 3, radiator 2 and propeller fan 1 configured as one and mounted in an engine room of the vehicle on the vehicle front L side.

Figure 2:
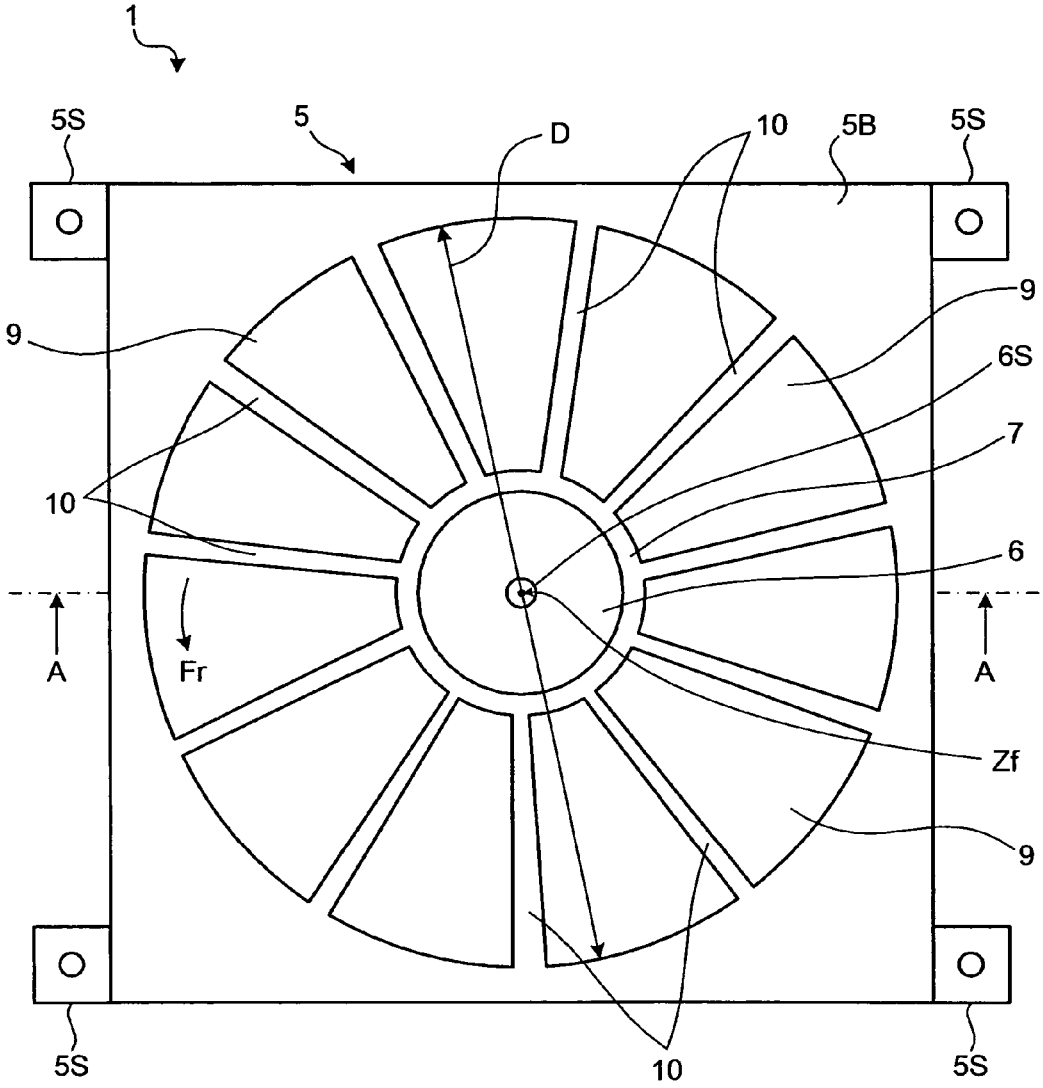
FIG. 2 is a front view showing a state of the propeller fan according to the first embodiment of the present invention viewed from a vehicle front side.
Figure 3:
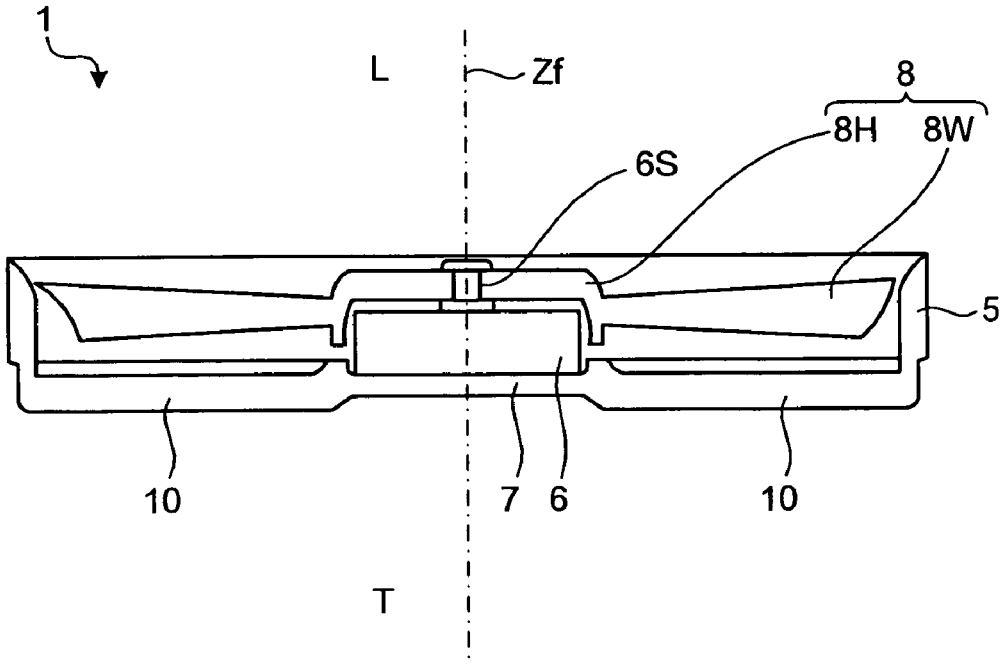
FIG. 3 is an A to A arrow view of FIG. 2.
Figure 4:
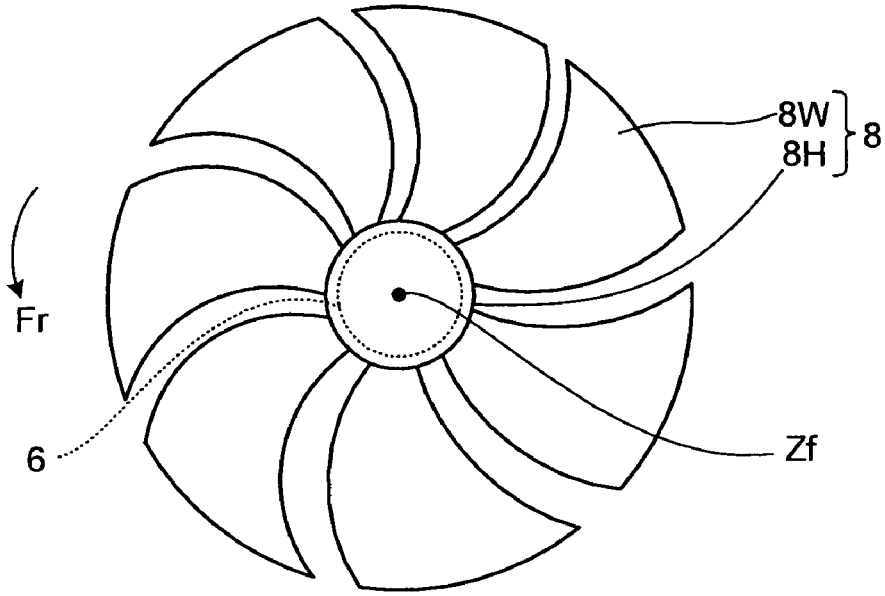
FIG. 4 is a front view showing a rotary vane wheel provided to the propeller fan according to the first embodiment of the present invention.

FIG. 2 is a front view showing a state of the propeller fan according to the first embodiment viewed from the vehicle front side. FIG. 3 is an A to A arrow view of FIG. 2. FIG. 4 is a front view showing the rotary vane wheel provided to the propeller fan according to the first embodiment. The rotary vane wheel is omitted in FIG. 2. As shown in FIG. 3, the propeller fan according to the first embodiment comprises a rotary vane wheel 8 shown in FIG. 4, a shroud 5 shown in FIG. 2 and an electric motor (rotary vane wheel driving means) 6 shown in FIGS. 2 and 3.

The rotary vane wheel 8 shown in FIG. 4 is configured by a hub 8H and multiple blade portions 8W mounted on an outer circumferential portion thereof. The rotary vane wheel 8 comprises 7 blade portions 8W. However, the number of the blade portions 8W is not limited thereto. As shown in FIG. 3, the hub 8H of the rotary vane wheel 8 is mounted on a rotation axis 6S of the electric motor 6. The electric motor 6 rotates the rotary vane wheel 8 centering on a rotation axis Zf, and lefts air W flow from the vehicle front L side to the vehicle rear T. In that process, the air W exchanges heat with the coolant and refrigerant flowing inside the radiator 2 and the condenser 3. Here, a rotation direction of the rotary vane wheel 8 is a direction Fr in FIGS. 2 and 4. And the rotation axis Zf is the rotation axis of the electric motor 6 and the rotary vane wheel 8.

The shroud 5 comprises a mount pedestal 7 for mounting the electric motor 6 as the rotary vane wheel driving means. As shown in FIG. 2, the mount 7 is supported on a body portion 5B of the shroud 5 by multiple support beams 10 radially extending from the rotation axis Zf. A ventilation flue 9 is formed between the mount 7 and the body portion 5B. As shown in FIG. 2, the ventilation flue 9 is divided off by the support beams 10. Here, the number of the support beams 10 is 11 in the first embodiment. However, the number of the support beams 10 is not limited thereto.

The engine room of the vehicle hardly has space because it has not only an engine as a power source of the vehicle but also its accessories mounted therein. In particular, it is necessary in recent years to secure a crushable zone for the traveling direction of the vehicle for the sake of improving collision safety so that devices mounted in the engine room are limited as to a dimension in the traveling direction of the vehicle. For this reason, the propeller fan 1 for cooling the condenser 3 and radiator 2 is also limited as to the dimension in a flow direction of the air W, that is, the direction parallel with the rotation axis Zf of the rotary vane wheel 8 of the propeller fan 1.

Because of this limitation of the dimension, space between the support beams 10 and the blade portions 8W of the rotary vane wheel 8 is also limited so that a sufficient dimension cannot be secured. Here, during operation of the propeller fan 1, the rotary vane wheel 8 rotates at high speed and so the support beams 10 on a stationary side and the blade portions 8W of the rotary vane wheel 8 perform relative movement at high speed. In the case where the space between the support beams 10 and the blade portions 8W of the rotary vane wheel 8 cannot be secured sufficiently, it furthers pressure interference generated by the relative movement between the support beams 10 and the blade portions 8W and generates harsh noise called discrete frequency noise. Thus, the propeller fan 1 according to the first embodiment has the following configuration of the support beams 10 provided to the shroud 5 in order to cope with this problem.

Figure 5:
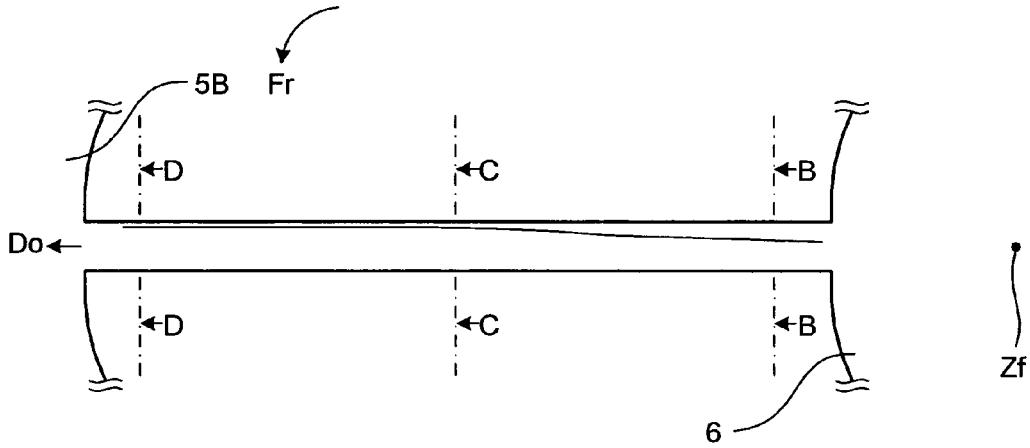
FIG. 5 is a plan view showing support beam provided to a shroud of the propeller fan according to the first embodiment of the present invention.
Figure 6:
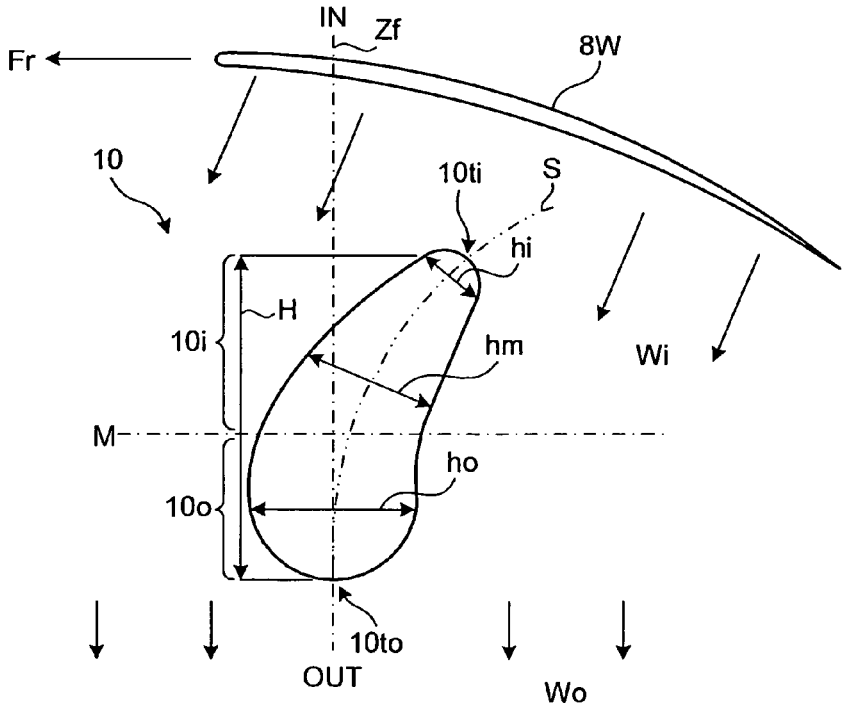
FIG. 6 is a sectional view of the support beam provided to the shroud of the propeller fan according to the first embodiment of the present invention.
Figure 7:
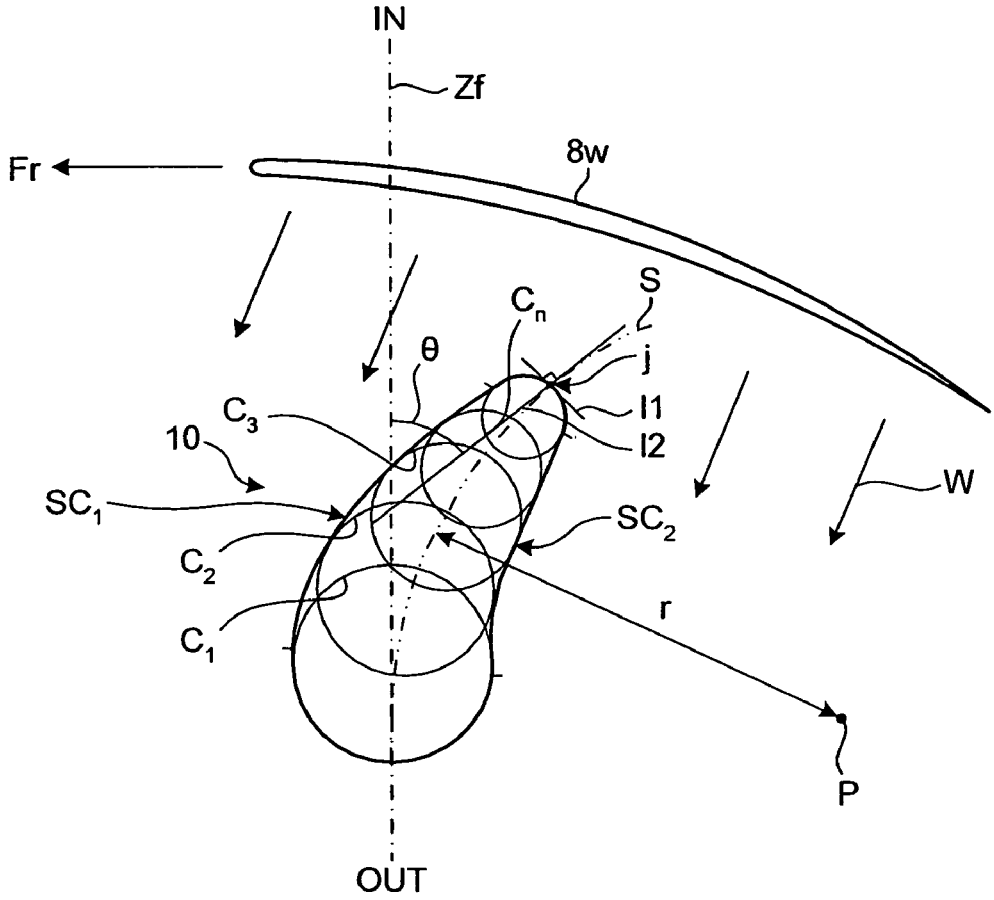
FIG. 7 is a sectional view of the support beam provided to the shroud of the propeller fan according to the first embodiment of the present invention.
Figure 8A:
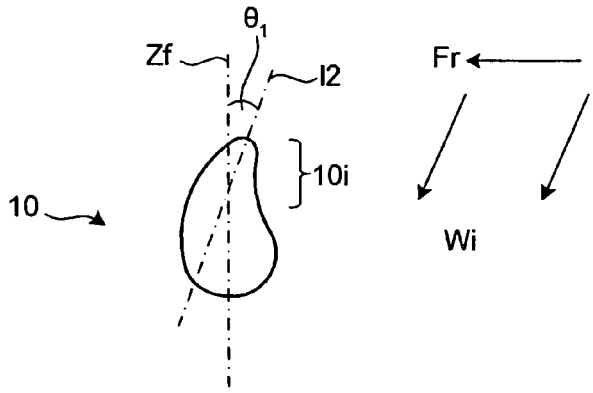
FIG. 8A is a B to B sectional view of FIG. 5.
Figure 8B:
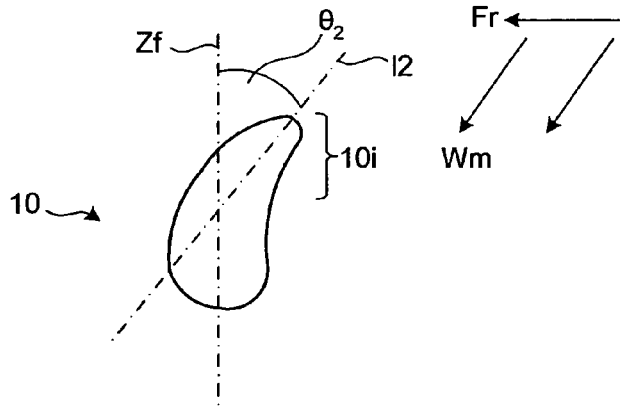
FIG. 8B is a C to C sectional view of FIG. 5.
Figure 8C:
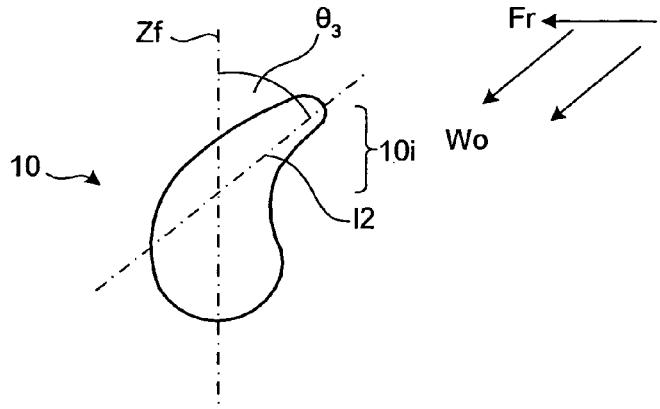
FIG. 8C is a D to D sectional view of FIG. 5.

FIG. 5 is a plan view showing the support beam provided to the shroud of the propeller fan according to the first embodiment. FIG. 5 shows a state of one of the support beams provided to the shroud viewed from the vehicle front side. FIGS. 6 and 7 are sectional views of the support beam provided to the shroud of the propeller fan according to the first embodiment. FIG. 8A is a B to B sectional view of FIG. 5, FIG. 8B is a C to C sectional view of FIG. 5, and FIG. 8C is a D to D sectional view of FIG. 5. Here, a section of the support beam means a longitudinal direction of the support beam, that is, the section orthogonal to the radial direction of the rotary vane wheel.

The support beams 10 provided to the shroud 5 of the propeller fan 1 according to the first embodiment are configured so that thickness h of the support beams 10 becomes larger from an upstream side (IN side of FIG. 6) of the flow direction of the air discharged by the rotary vane wheel 8 toward a downstream side (OUT side of FIG. 6) of the flow direction of the air discharged by the rotary vane wheel 8. And an edge (hereafter, a downstream side edge) $\mathbf{10}_{to}$ of the support beams 10 on the downstream side of the flow direction of the air discharged by the rotary vane wheel 8 is inclined to be oriented toward a direction parallel with the rotation axis Zf of the rotary vane wheel 8, and an edge (hereafter, an upstream side edge) $\mathbf{10}_{ti}$ of the support beams 10 on the upstream side of the flow direction of the air discharged by the rotary vane wheel 8 is inclined to be oriented toward a direction opposite to the rotation direction Fr of the rotary vane wheel 8. Here, the thickness of the support beam 10 means the dimension in a direction orthogonal to a center line S of the support beam 10 in a cross-section of the support beam 10.

In such a configuration, when the air discharged by the rotary vane wheel 8 passes through the support beams 10, the flow of the air discharged from the rotary vane wheel 8 (arrows Wi of FIG. 6) is changed to the direction of the rotation axis Zf of the rotary vane wheel 8 (arrows Wo of FIG. 6) by the support beams 10. To be more specific, the support beams 10 rectify the flow of the air discharged by the rotary vane wheel 8 to reduce circling components thereof. As an upstream side 10*i* of the support beams 10 is inclined toward the direction opposite to the rotation direction Fr of the rotary vane wheel 8, the air discharged by the rotary vane wheel 8 flows smoothly along the upstream side 10*i* of the support beams 10 and the direction of the flow is gradually changed. It is possible, by these actions, to reduce pressure interference between the rotary vane wheel 8 and the support beams 10 so as to prevent generation of the noise of discrete frequency components as a noise source.

The thickness h of the support beams 10 becomes gradually larger from the upstream side edge portion $\mathbf{10}_{ti}$ toward the downstream side edge portion $\mathbf{10}_{to}$, and the downstream side edge portion $\mathbf{10}_{to}$ faces the direction parallel with the rotation axis Zf of the rotary vane wheel 8. To be more specific, as shown in FIG. 6, the thickness of the support beams 10 becomes gradually larger from the upstream side edge portion $\mathbf{10}_{ti}$ toward the downstream side edge portion $\mathbf{10}_{to}$ in order of hi, hm and ho. As the support beams 10 have such a cross-section, it is possible to increase geometric moment of inertia and secure a cross section on the downstream side 10*o* of the support beams 10 so as to secure sufficient strength of the rotary vane wheel 8 in the rotation axis Zf direction. It is thereby possible to secure sufficient strength to bear a road surface vibrational acceleration when mounted on the vehicle in addition to a static load and a vibrational load of the electric motor 6 and the rotary vane wheel 8.

Here, the upstream side 10*i* of the support beams 10 refers to the range further on the blade portion 8W side of the rotary vane wheel 8 than an approximate center M of a length H of the support beams 10 in the rotation axis Zf direction of the rotary vane wheel 8. The downstream side 10*o* of the support beams 10 refers to the range further on the downstream side (OUT side of FIG. 6) of the flow direction of the air discharged by the rotary vane wheel 8 than the approximate center M of the length H of the support beams 10 in the rotation axis Zf direction of the rotary vane wheel 8.

The cross-section of the support beam 10 can be configured as shown in FIG. 7 for instance. Reference character S refers to the center line in the cross section orthogonal to the longitudinal direction of the support beams 10. The center line S is rendered as an arc of ¼ or less centering on a virtual center point P, and the center of a first circle $C_1$, configuring the downstream side edge portion $\mathbf{10}_{to}$ is placed on the center line S. And, as well as the first circle $C_1$, a second circle $C_2$, a third circle $C_3$ and so on having their centers on the center line S are placed by rendering their radiuses smaller gradually toward the upstream side edge portion $\mathbf{10}_{ti}$ according to a distance from the downstream side edge portion $\mathbf{10}_{to}$ to the upstream side edge portion $\mathbf{10}_{ti}$. The center of an n-th circle $C_n$ configuring the upstream side edge portion $\mathbf{10}_{ti}$ is placed on the most upstream position on the center line S, that is, the position opposed to the rotary vane wheel 8. Here, if the radius of the first circle $C_1$, is $r_1$, the radius of the second circle $C_2$ is $r_2$, . . . and the radius of the n-th circle $C_n$ is $r_n$, it is $r_1>r_2>r_n$.

Thus, after placing the first circle $C_1$, configuring the downstream side edge portion $\mathbf{10}_{to}$ to the n-th circle $C_n$ configuring the upstream side edge portion $\mathbf{10}_{ti}$ in sequence, they are connected by an envelope including parts on circumferences of the first circle $C_1$, second circle $C_2$, third circle $C_3$ to n-th circle $C_n$, irrespectively. The cross-section of the support beam 10 according to the first embodiment is composed of a contour configured by two envelopes $SC_1$, and $SC_2$, the arc of the first circle $C_1$ on the downstream side in the airflow direction and the arc of the n-th circle $C_n$, on the upstream side in the airflow direction. A technique for deciding the cross-section of the support beam 10 according to the first embodiment is not limited to this.

The support beams 10 provided to the shroud 5 according to the first embodiment has the inclination of the upstream side edge portion $\mathbf{10}_{ti}$ varied toward the outside of the longitudinal direction of the support beams 10 (arrow Do direction of FIG. 5), that is, as directed from the mount 7 side to the body portion SB of the shroud 5. As shown in FIG. 7, reference character $l_1$ denotes a tangent of the upstream side edge portion $\mathbf{10}_{ti}$ at an intersecting point j between the upstream side edge portion $\mathbf{10}_{ti}$ configured by the arc and the center line S of the support beam 10 on the cross section orthogonal to the longitudinal direction of the support beams 10. And reference character $l_2$ denotes a straight line orthogonal to the tangent $l_1$ while reference character θ denotes an angle of gradient made by the straight line 12 and a plane including the rotation axis Zf of the rotary vane wheel 8. To be more specific, the angle of gradient θ indicates the inclination of the upstream side edge portion $\mathbf{10}_{ti}$ (inclination to the plane including the rotation axis Zf of the rotary vane wheel 8).

As shown in FIGS. 8A to 8C, the angle of gradient θ becomes larger as directed toward the outside of the longitudinal direction of the support beams 10. To be more specific, it is $\theta_3>\theta_2>\theta_1$. To be more specific, as directed from the inside of the longitudinal direction (the mount 7 side) of the support beams 10 toward the outside of the longitudinal direction (the body portion 5B of the shroud 5), an opening becomes larger between the plane including the rotation axis Zf of the rotary vane wheel 8 and the upstream side edge portion $\mathbf{10}_{ti}$. A circumferential velocity of the rotary vane wheel 8 becomes higher from the inside toward the outside of the rotary vane wheel 8, and the circling components of the air discharged by the rotary vane wheel 8 become stronger accordingly. To be more specific, the flows of the air discharged by the rotary vane wheel 8 become those denoted by reference characters Wi, Wm and Wo as directed toward the outside of the radial direction of the rotary vane wheel 8 respectively. However, the components in the rotation direction Fr of the rotary vane wheel 8 become larger as the flows of the air discharged by the rotary vane wheel 8 are directed toward the outside of the radial direction of the rotary vane wheel 8.

The support beams 10 provided to the shroud 5 according to the first embodiment enlarges the opening between the plane including the rotation axis Zf of the rotary vane wheel 8 and the upstream side edge portion $\mathbf{10}_{ti}$. It is thereby possible to reduce the pressure interference between the rotary vane wheel 8 and the support beams 10 all over the longitudinal direction of the support beams 10 so as to prevent generation of the noise of the discrete frequency components more effectively. As the downstream side edge portion $\mathbf{10}_{to}$ is directed toward the rotation axis Zf of the rotary vane wheel 8, it is also possible to increase geometric moment of inertia and secure sufficient strength.

Figure 9:
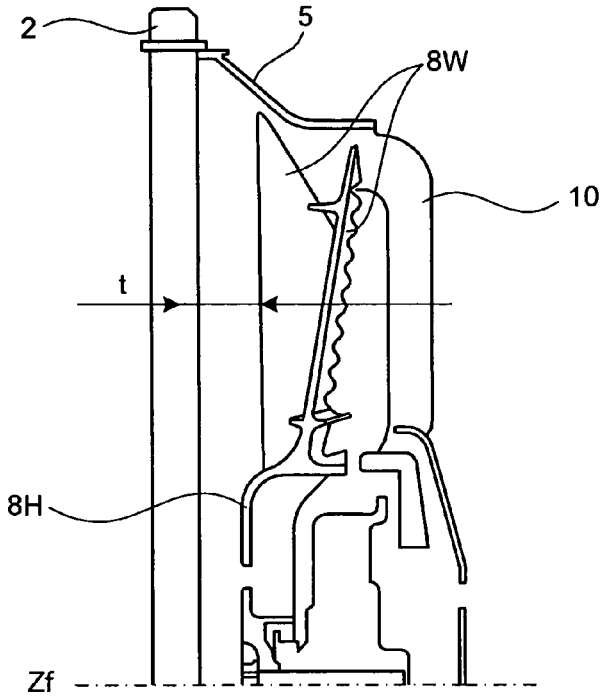
FIG. 9 is a partial sectional view showing the propeller fan according to the first embodiment of the present invention.
Figure 10:
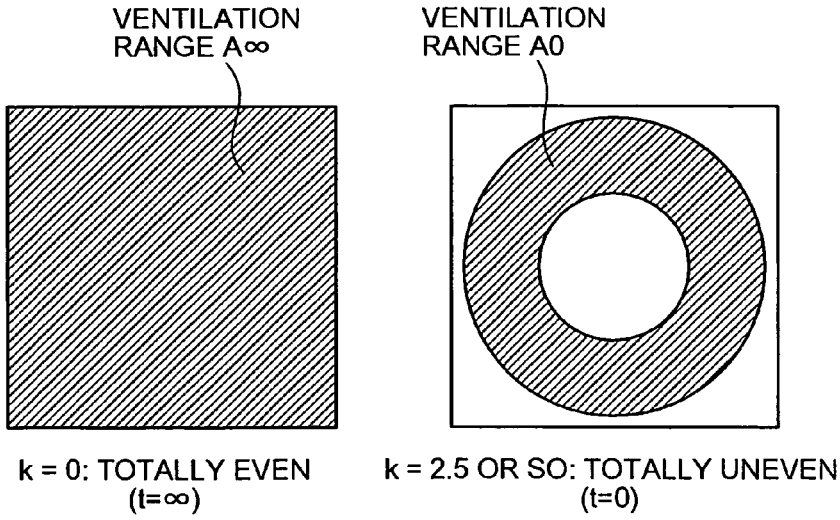
FIG. 10 is a schematic diagram of a ventilation range of the propeller fan.
Figure 11:
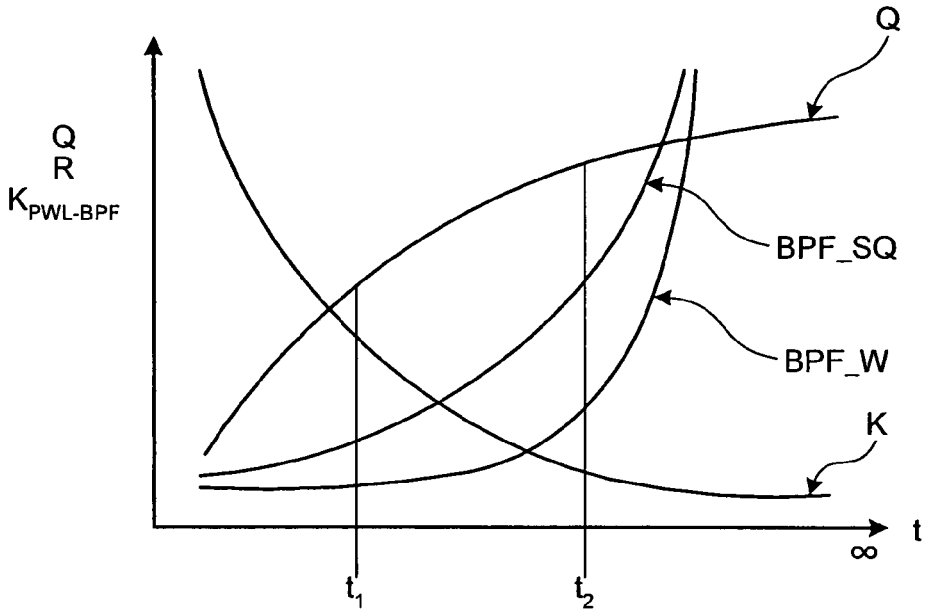
FIG. 11 is a schematic diagram showing a relation of a discharge flow of the rotary vane wheel, a specific sound level $K_{PWL\text{-}BPF}$ relating to acoustic power based on a discrete frequency BPF and a flow concentration coefficient value R against a distance between a blade portion of the rotary vane wheel and the heat exchanger.

FIG. 9 is a partial sectional view showing the propeller fan according to the first embodiment. FIG. 10 is a schematic diagram of a ventilation range of the propeller fan. FIG. 11 is a schematic diagram showing a relation of a discharge flow of the rotary vane wheel, a specific sound level $K_{PWL\text{-}BPF}$ relating to acoustic power based on a discrete frequency BPF and a flow concentration coefficient value R against a distance between the blade portion of the rotary vane wheel and the heat exchanger. Here, a distance t shown in FIG. 9 indicates the distance between the blade portion 8W of the rotary vane wheel 8 and the heat exchanger.

The value R shown in FIG. 11 will be described by using FIG. 10. FIG. 10 shows on its left side a ventilation range A ∞ of the propeller fan 1 in the case where the distance t is infinite, that is, the distance between the blade portion 8W of the rotary vane wheel 8 and the heat exchanger is infinitely apart. The value R in this case is 0 so that the air flows from the heat exchanger to the propeller fan with complete uniformity. FIG. 10 shows on its right side a ventilation range $A_0$ of the propeller fan 1 in the case where the distance t is 0, that is, there is no distance between the blade portion 8W of the rotary vane wheel 8 and the heat exchanger. The value R in this case is approximately 2.5 so that the air flows from the heat exchanger through the portion of the blade portion 8W of the rotary vane wheel 8. Here, the value R is represented by a formula (1).

$$R=\sqrt{((1/A)\times\int_A(u(a))-u_av)^2da)} \quad (1)$$

Here, A denotes area of the entire region, u (a) denotes dimensionless velocity in a miniregion a. And u_av is an average of the velocity in the entire region rendered dimensionless, which is 1.

As shown in FIG. 11, a discharge flow Q of the rotary vane wheel 8 increases as the distance t is rendered larger, that is, as the distance between the heat exchanger and the blade portion 8W of the rotary vane wheel 8 is rendered larger. If the value R is rendered larger than $t_2$, the value R becomes asymptotic to an approximately fixed value. Therefore, it is desirable to render the distance t between the blade portion 8W of the rotary vane wheel 8 and the heat exchanger as large as possible, that is, at least larger than $t_2$.

If the t is rendered larger, however, the distance between the blade portion 8W of the rotary vane wheel 8 and the support beams 10 becomes closer so that noise components based on the discrete frequency BPF (Blade Passing Frequency) (that is, the specific sound level relating to the acoustic power based on the BPF of FIG. 11) become larger. Here, BPF_SQ of FIG. 11 is the noise component based on the BPF having a rectangular cross section of the support beam, and BPF_W is the noise component based on the BPF of the support beam 10 according to the first embodiment. In the case where the distance t between the blade portion 8W of the rotary vane wheel 8 and the heat exchanger is the same, the support beam 10 according to the first embodiment can render the noise component based on the BPF smaller compared to the support beam of the rectangular cross section. To be more specific, the support beam 10 according to the first embodiment can render the distance t between the blade portion 8W of the rotary vane wheel 8 and the heat exchanger larger while suppressing the noise component based on the BPF. Consequently, it is possible to render the discharge flow Q of the rotary vane wheel 8 larger while suppressing the noise component based on the BPF. Next, a description will be given as to a modified example of the support beam provided to the shroud of the propeller fan according to the first embodiment.

Figure 12A:
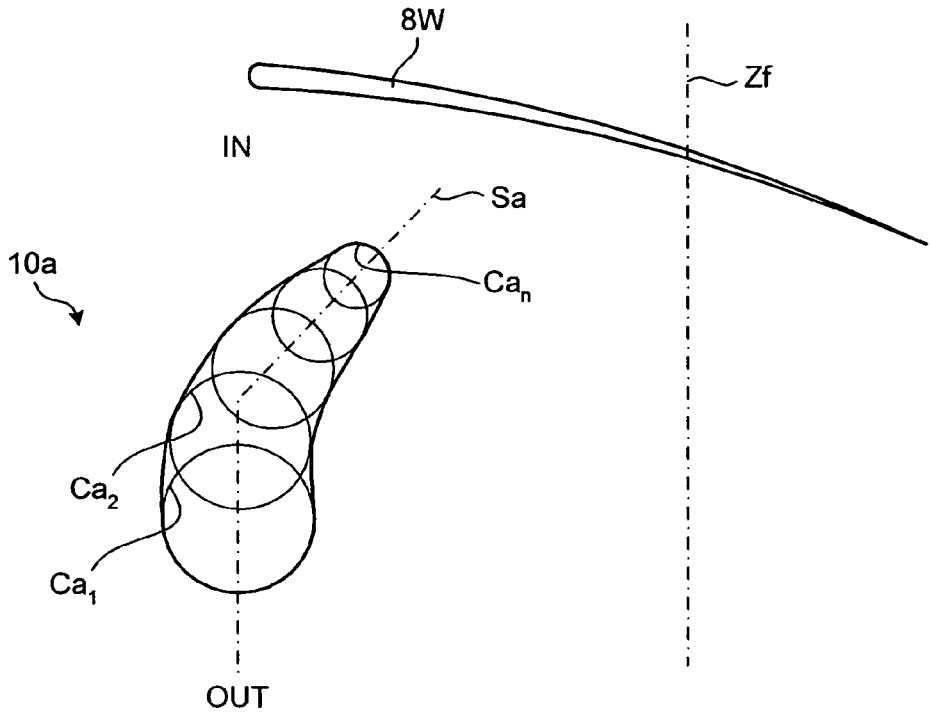
FIG. 12A is a schematic diagram showing a modified example of the support beam provided to the shroud of the propeller fan according to the first embodiment of the present invention.
Figure 12B:
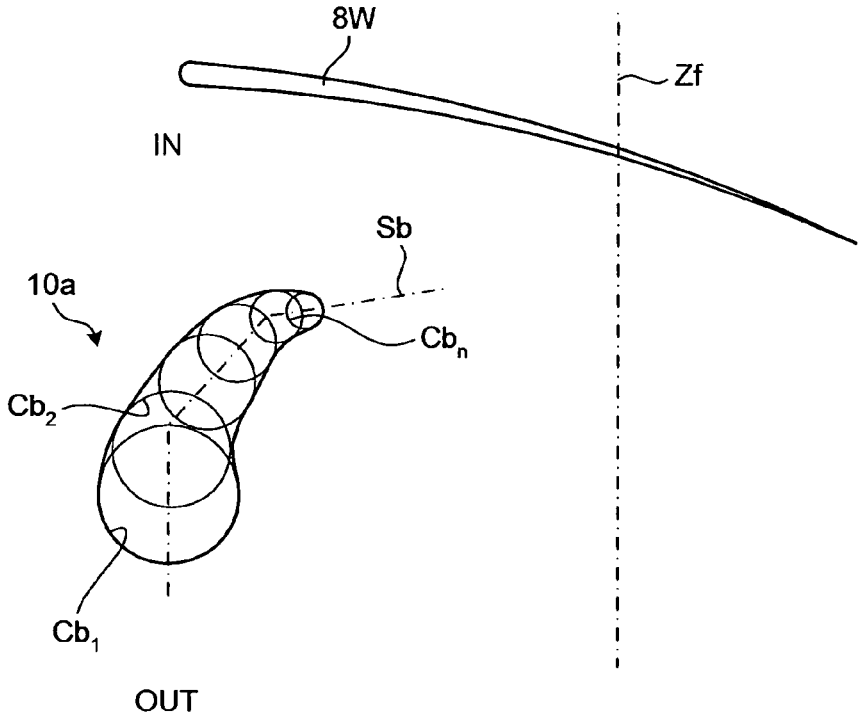
FIG. 12B is a schematic showing a modified example of the support beam provided to the shroud of the propeller fan according to the first embodiment of the present invention.
Figure 12C:
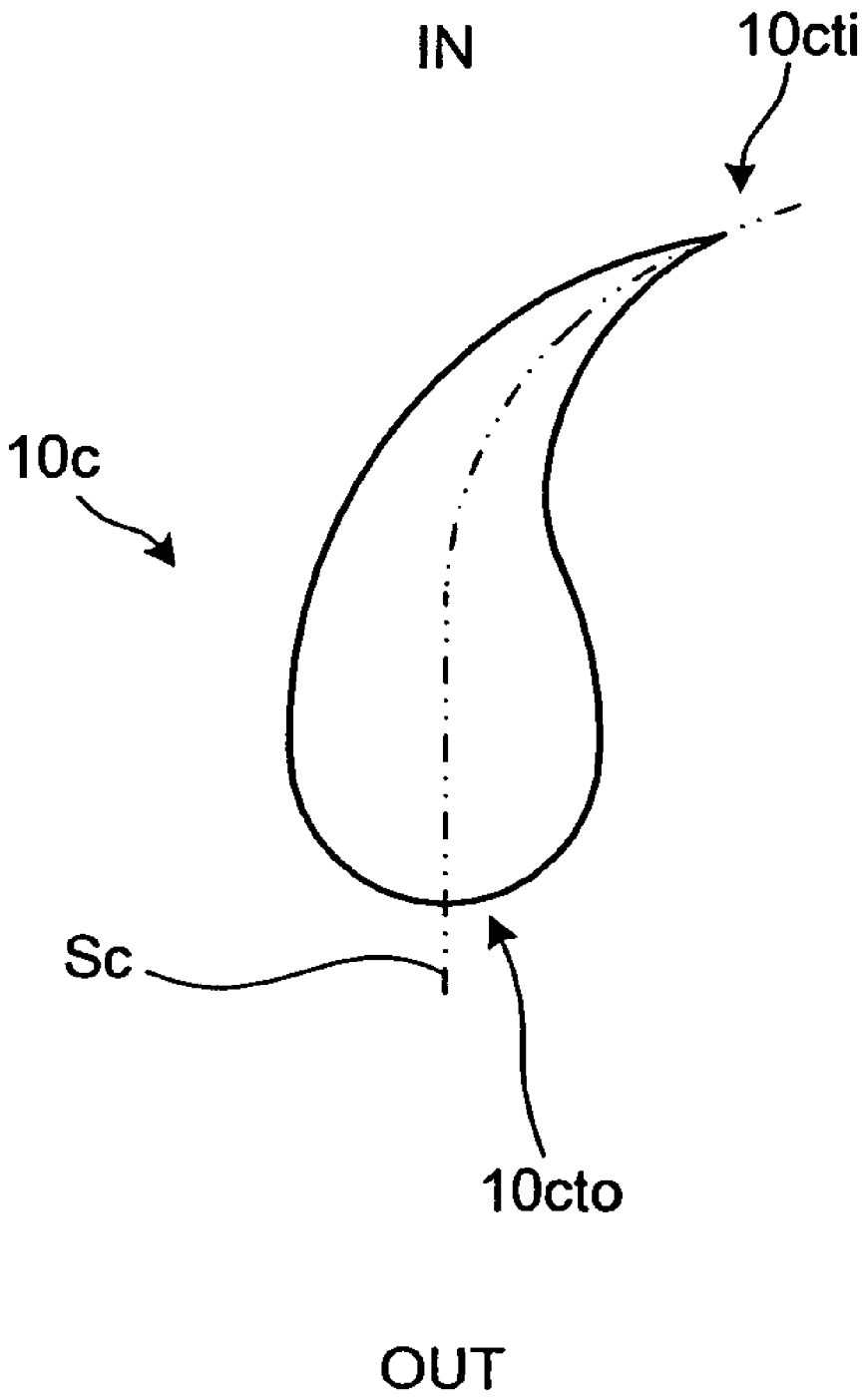
FIG. 12C is a schematic showing a modified example of the support beam provided to the shroud of the propeller fan according to the first embodiment of the present invention.
Figure 13:
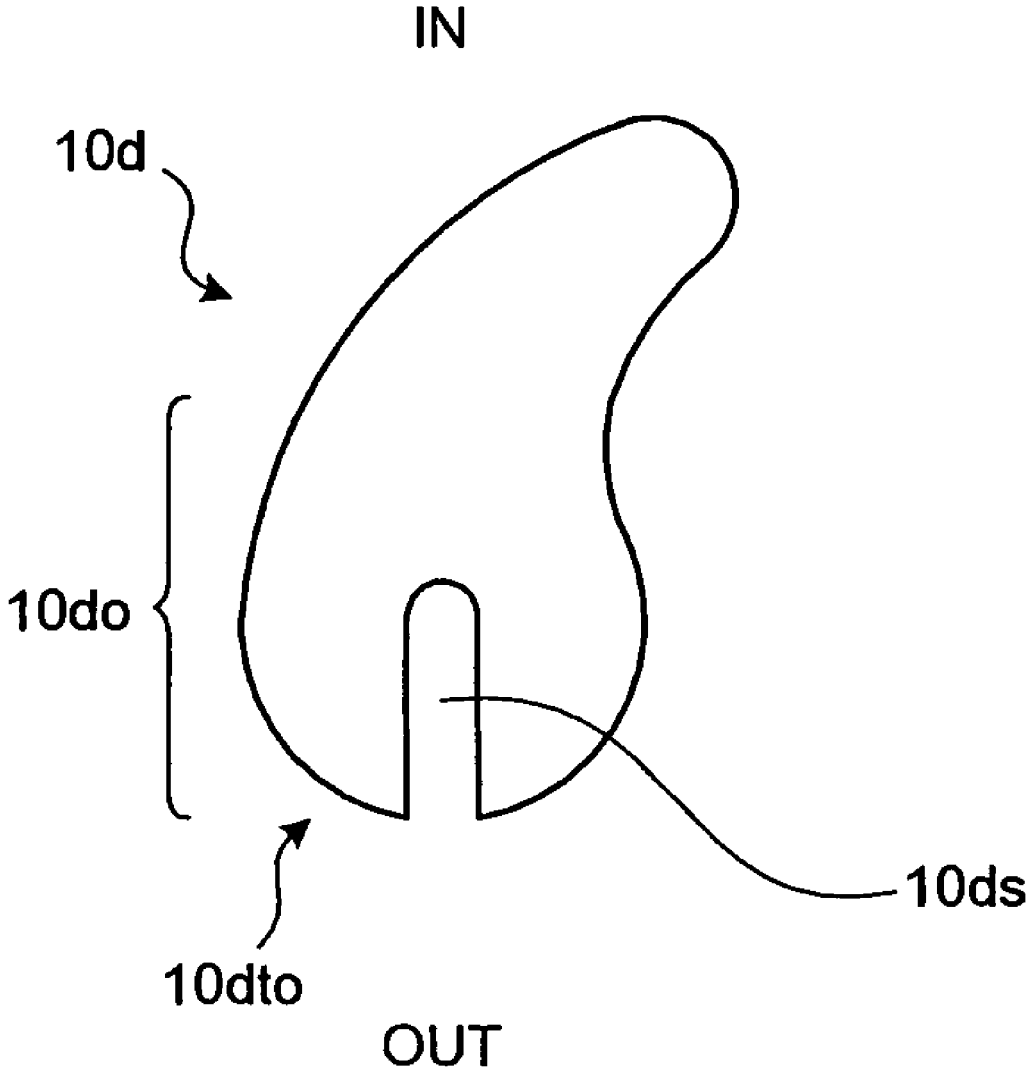
FIG. 13 is a schematic diagram showing a modified example of the support beam provided to the shroud of the propeller fan according to the first embodiment of the present invention.

FIGS. 12A to 12C are schematic diagrams showing a modified example of the support beam provided to the shroud of the propeller fan according to the first embodiment. FIG. 13 shows a modified example of the support beam provided to the shroud of the propeller fan according to the first embodiment. It is possible to configure a center line Sa by combining two straight lines as with a support beam 10*a* shown in FIG. 12A. It is also possible to configure a center line Sb by combining three straight lines as with a support beam 10*b* shown in FIG. 12B.

It is also possible to render an upstream side edge $\mathbf{10}_{cti}$ in a sharp-edge shape rather than the arc as with a support beam 10*c* shown in FIG. 12C. It is thereby possible to further reduce resistance of the air discharged by the rotary vane wheel 8. Here, sharp-edge refers to the case where the upstream side edge $\mathbf{10}_{cti}$ is an arc, the radius of the arc being 0.5 mm or less.

Furthermore, it is also possible to form a groove $\mathbf{10}_{ds}$ on a downstream side $\mathbf{10}_{do}$ as with a support beam 10*d* shown in FIG. 13. It is thereby possible, for instance, to house electric wire for supplying power to the electric motor 6 in the groove $\mathbf{10}_{ds}$ so as to exploit the space effectively. It is possible, as a part of the support beam 10*d* is eliminated, to render the support beam 10*d* further lightweight. It is also possible to render the support beam as a hollow structure. It is also possible, in this case, to place the electric wire, signal line and the like in the hollow portion and render it further lightweight by providing the hollow portion.

As described above, the first embodiment and modified example thereof have the upstream side of the support beam inclined toward the direction opposite to the rotation direction of the rotary vane wheel, and so the air discharged by the rotary vane wheel flows smoothly along the upstream side of the support beams and the direction of the flow is gradually changed. The downstream side edge of the support beam is oriented toward the direction parallel to the rotation axis of the rotary vane wheel. It is thereby possible to rectify the circling components of the flow of the air discharged by the rotary vane wheel to reduce them so as to reduce the pressure interference between the rotary vane wheel and the support beams and prevent generation of the noise of discrete frequency components as a noise source.

The support beams become gradually thicker from the upstream side edge toward the downstream side edge, and the downstream side edge faces the direction parallel with the rotation axis of the rotary vane wheel. As the support beams have such a cross-section, it is possible to increase geometric moment of inertia of the support beams. It is possible to secure a sufficient cross section on the downstream side of the support beams. It is possible, by these actions, to secure sufficient strength in the rotation axis direction of the rotary vane wheel in particular. It is consequently possible, even in the case of limiting the dimension in the airflow direction, to reduce the noise and secure the strength of the support beams supporting the rotary vane wheel and rotary vane wheel driving means. It is thereby possible to reduce the number of the support beams and further reduce an aerodynamic drag and the noise.

Second Embodiment

Figure 14:
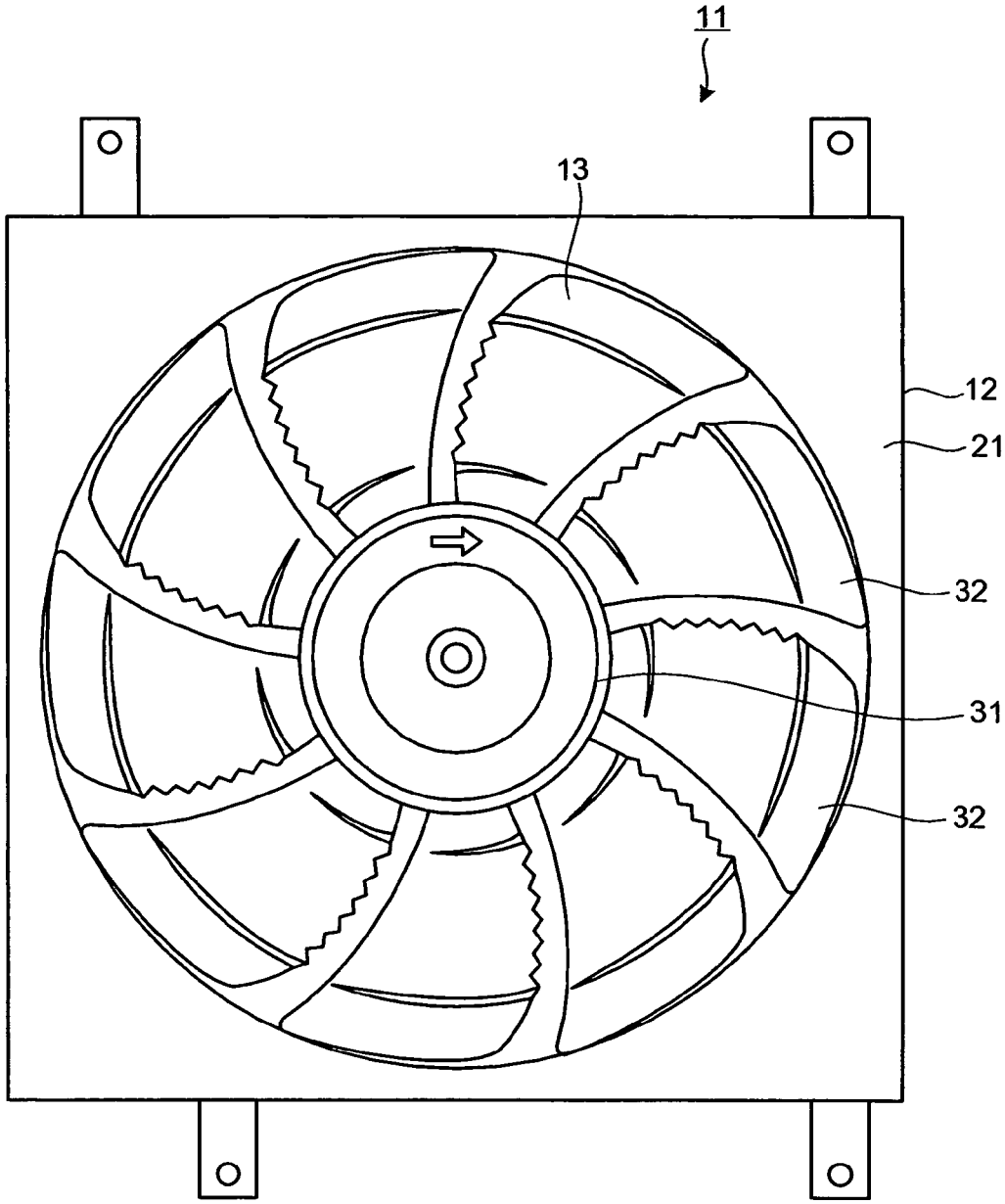
FIG. 14 is a front view showing the propeller fan according to a second embodiment of the present invention.
Figure 15:
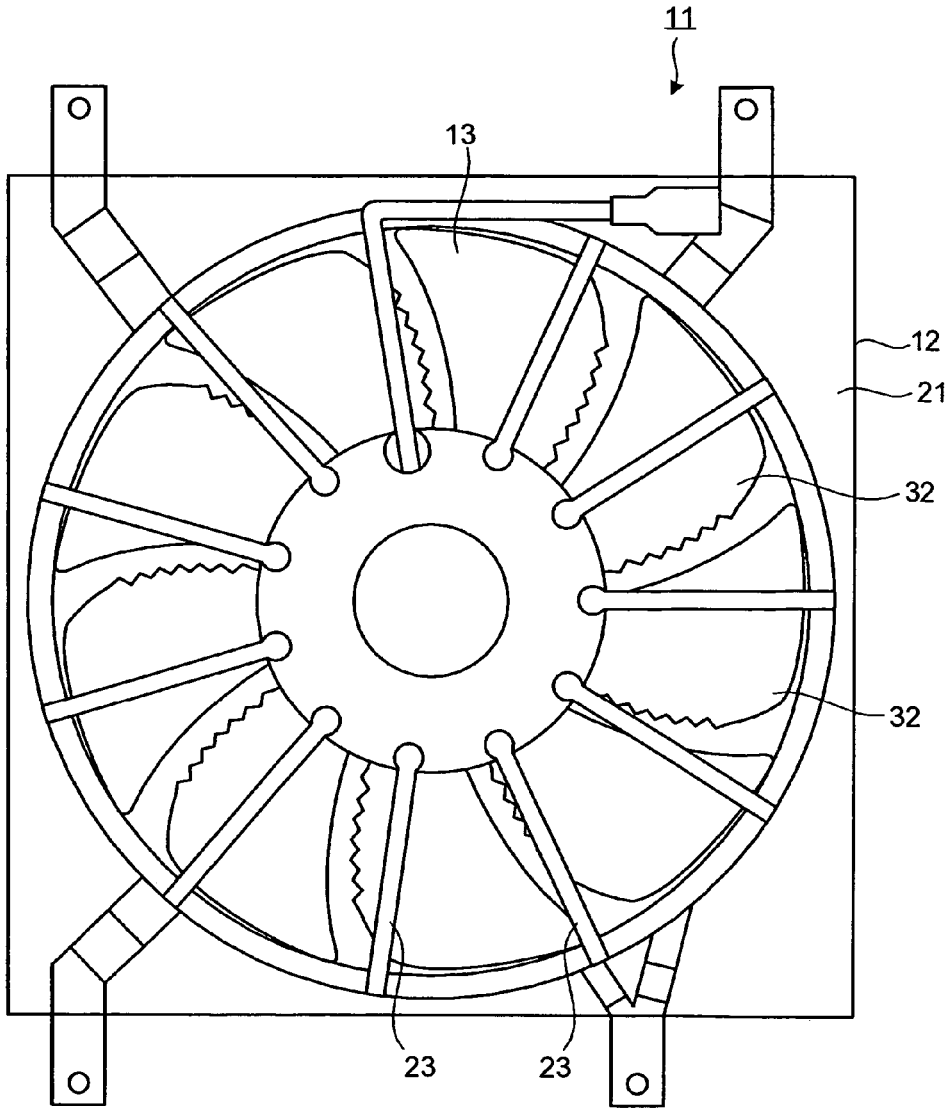
FIG. 15 is a rear view showing the propeller fan according to the second embodiment of the present invention.
Figure 16:
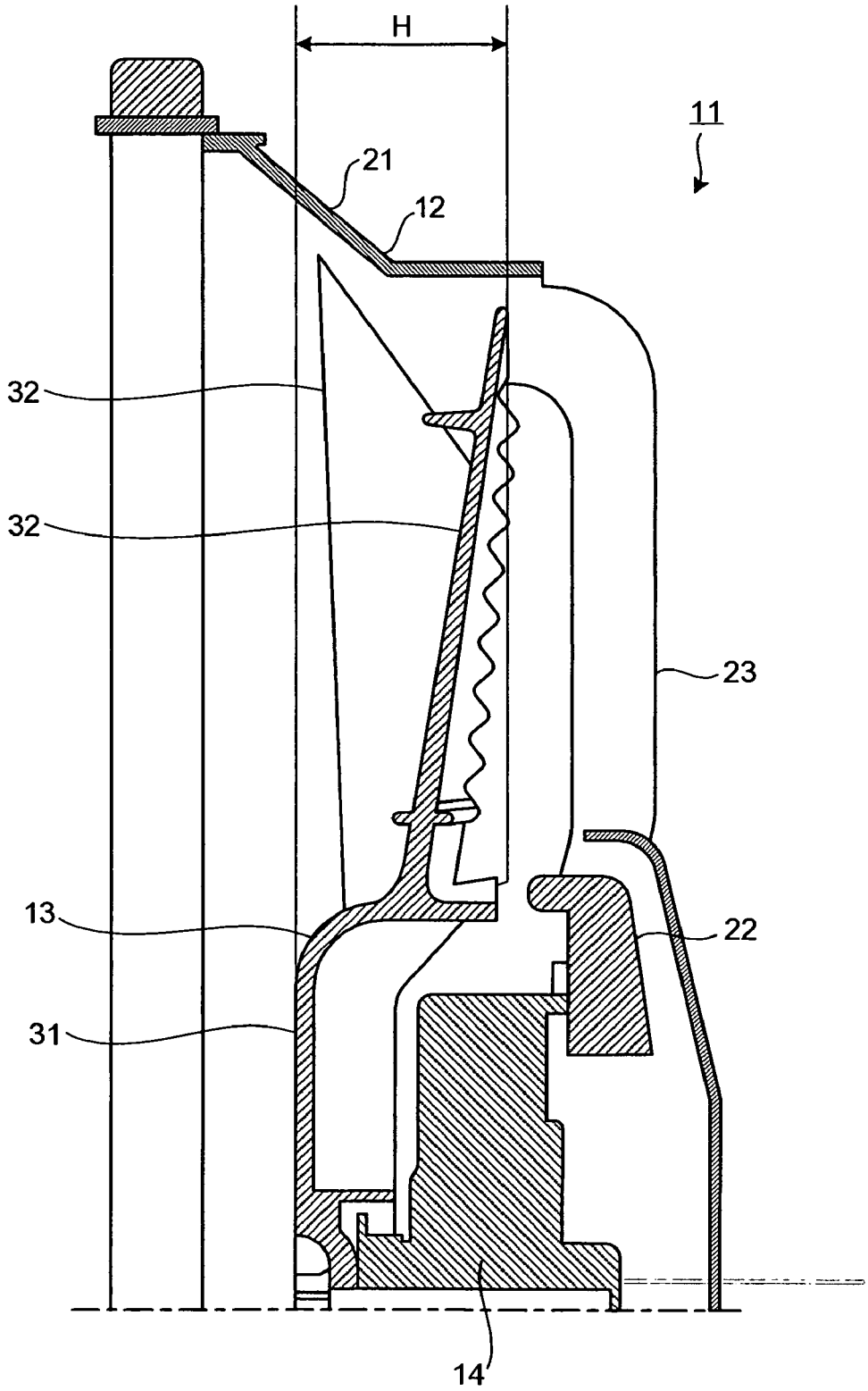
FIG. 16 is a side sectional view showing the propeller fan according to the second embodiment of the present invention.
Figure 17:
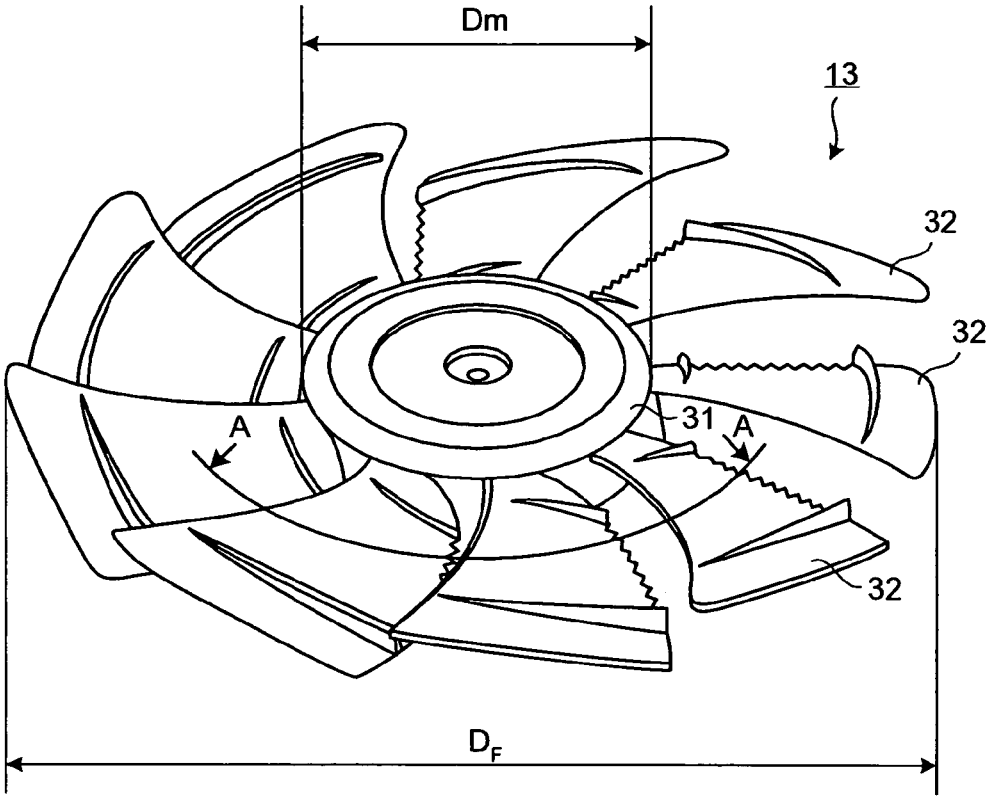
FIG. 17 is a front side perspective view showing the rotary vane wheel of the propeller fan described in FIGS. 14 to 16.
Figure 18:
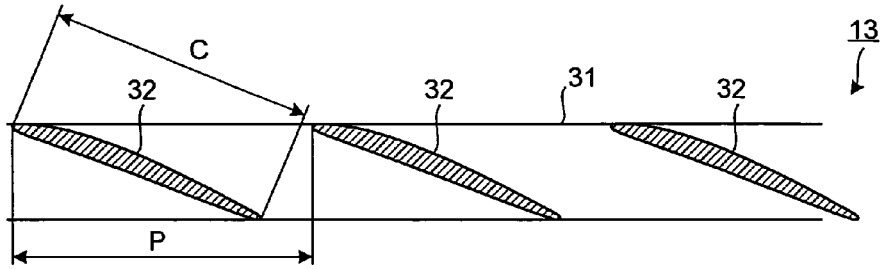
FIG. 18 is an A to A sectional view showing the blade portion of the rotary vane wheel described in FIG. 17.
Figure 19:
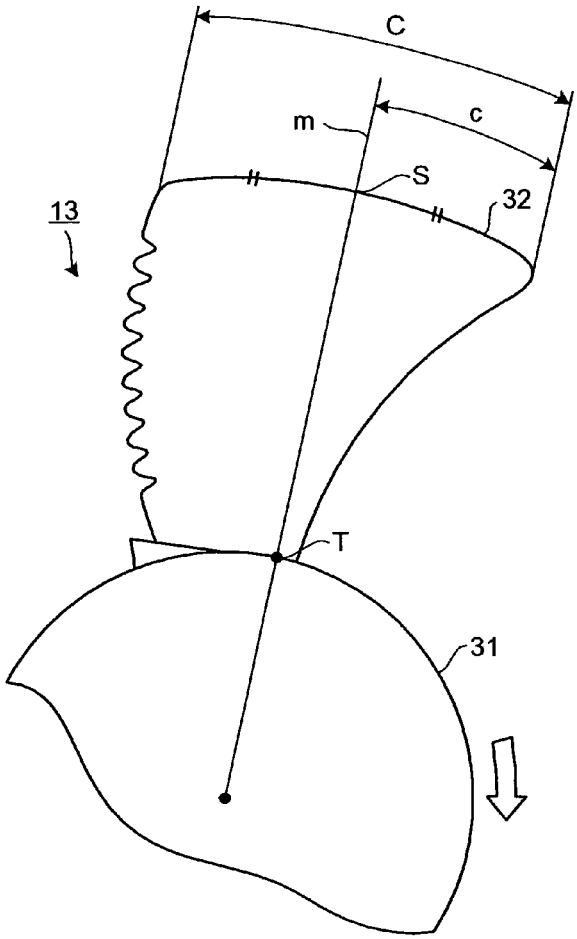
FIG. 19 is a plan view showing the blade portion of the rotary vane wheel described in FIG. 17.
Figure 20:
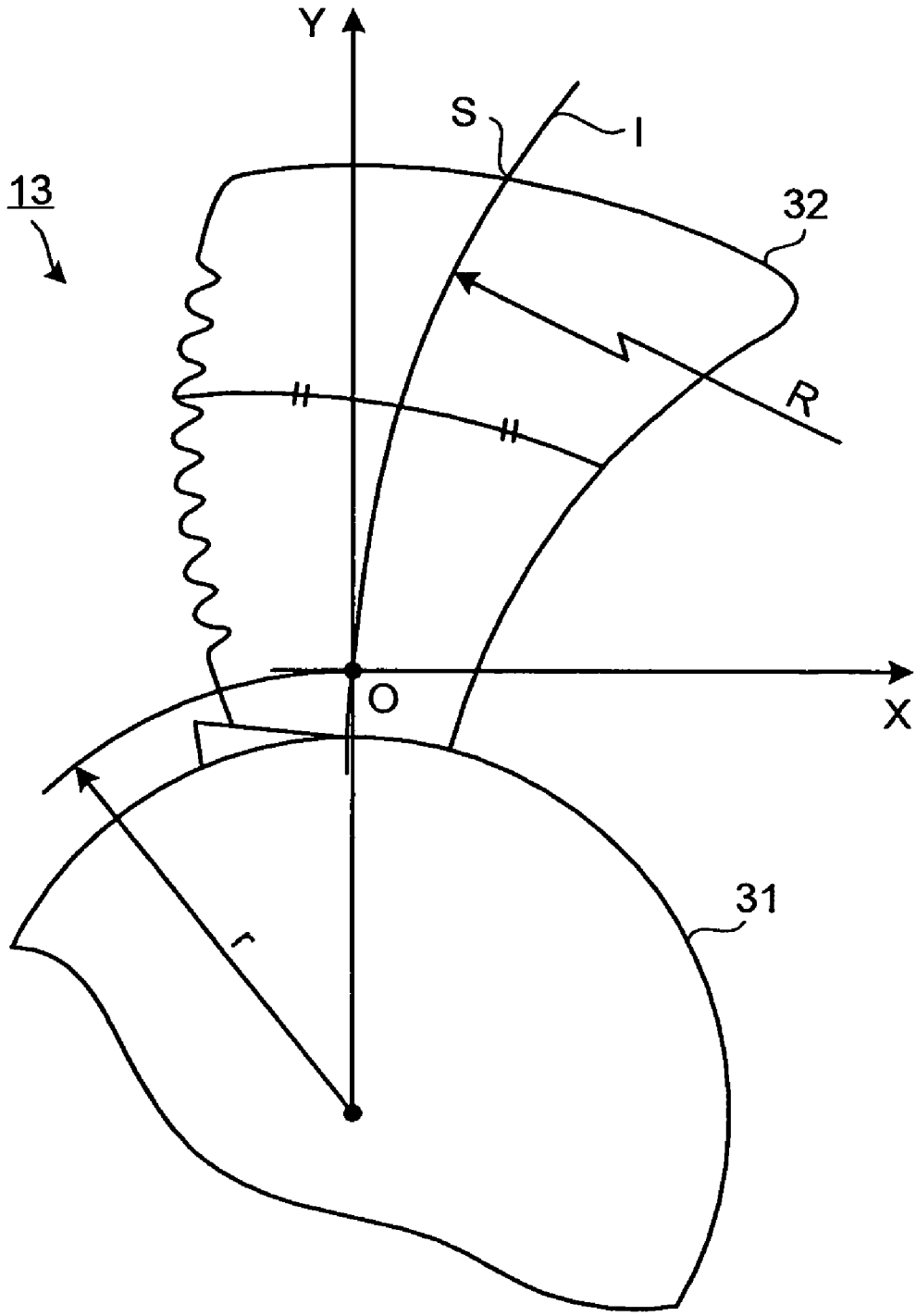
FIG. 20 is a plan view showing the blade portion of the rotary vane wheel described in FIG. 17.

FIGS. 14 to 16 are a front view (FIG. 14), a rear view (FIG. 15) and a side sectional view (FIG. 16) showing the propeller fan according to a second embodiment of the present invention. FIG. 17 is a front side perspective view showing the rotary vane wheel of the propeller fan described in FIGS. 14 to 16. FIGS. 18 to 20 are an A to A sectional view (FIG. 18) and plan views (FIGS. 19 and 20) showing the blade portion of the rotary vane wheel described in FIG. 17. FIGS. 21 to 24 are schematic diagrams showing the action of the propeller fan described in FIGS. 14 to 16.

This propeller fan 11 is placed in the downstream of the radiator for cooling the vehicle and the condenser for air conditioning and in proximity to the engine (not shown), and has a function of air-cooling the radiator and the condenser for air conditioning. The propeller fan 11 comprises a shroud 12, a rotary vane wheel 13 and a motor 14 (refer to FIGS. 14 to 16).

The shroud 12 is composed of a resin material, and includes a body portion 21, a motor holding portion 22 and a rib portion 23 (refer to FIG. 16). The body portion 21 is a frame-like member having an opening for introducing air at its center. The body portion 21 has the rotary vane wheel 13 and motor 14 accommodated therein. The motor holding portion 22 is a member for holding the motor 14, and is placed at the center of the opening of the body portion 21 while supported by the rib portion 23. The rotary vane wheel 13 is an axial fan having a hub portion 31 and a blade portion 32 composed of the resin material, and is configured by having multiple blade portions 32 annularly arranged on the hub portion 31 as a rotor (refer to FIG. 14). The motor 14 is a power source for rotating the rotary vane wheel 13. The motor 14 is coupled to the rotary vane wheel 13 on its output side (front side) and screwed and fixed on the motor holding portion 22 of the body portion 21 on its opposite output side (backside).

If the rotary vane wheel 13 is rotated by driving of the motor 14, the propeller fan 11 has the air introduced from the front (the side of the radiator for cooling and condenser for air conditioning) to the opening of the body portion 21 to be sent backward. Thus, the radiator and condenser are cooled.

[Noise Reduction Structure of the Rotary Vane Wheel]

Here, as regards the propeller fan 11, (1) flatness $H/D_F$ of the rotary vane wheel 13 is $H/D_F \leqq 0.12$ (refer to FIGS. 16 and 17). The flatness $H/D_F$ is defined by the ratio between an axial width H of the blade portion 32 and a diameter $D_F$ at an end of the blade portion 32. (2) A ratio $D_m/D_F$ between a diameter $D_m$ of the hub portion 31 and the diameter $D_F$ at the end of the blade portion 32 is $D_m/D_F \leqq 0.50$. To be more specific, annular channel area of cooling wind is defined by the ratio $D_m/D_F$. (3) A pitch chord ratio P/C of the blade portion 32 is $1.0 \leqq P/C \leqq 1.2$. The pitch chord ratio P/C is defined by the ratio between a circumferential pitch P and a chord length C of the blade portion 32 on an arbitrary cylindrical section A to A (refer to FIG. 18) in an annular radial dimension range in which a radius ratio (vane radius ratio) of the blade portion 32 is 10(%) to 95(%). (4) The outer circumferential side of the blade portion 32 is swept forward in the rotation direction of the rotary vane wheel 13 (forward swept vane).

In such a configuration, the diameter ratio $D_m/D_F$ between the hub portion 31 and the blade portion 32 and the pitch chord ratio P/C of the blade portion 32 are rendered appropriate on the rotary vane wheel 13 having a low degree of flatness $H/D_F$ while the blade portion 32 is the forward swept vane so as to prevent the rotation of the rotary vane wheel 13 from stalling. Thus, the air blowing performance (aerodynamic performance) in the sound operational area is improved so that the operation of the rotary vane wheel 13 becomes stable. This has an advantage of improving the noise performance, air blowing performance and air blowing efficiency of the propeller fan 11.

Figure 21:
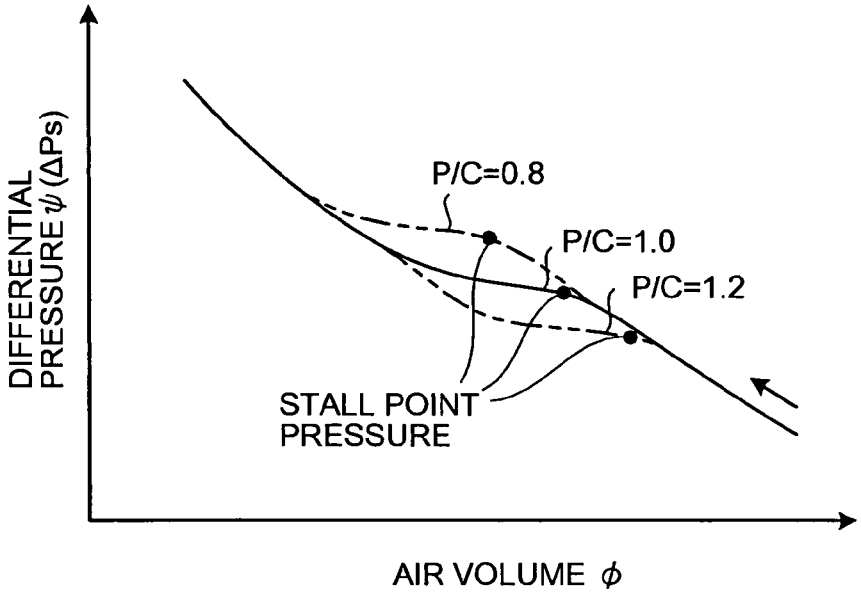
FIG. 21 is a schematic diagram showing the action of the propeller fan described in FIGS. 14 to 16.
Figure 22:
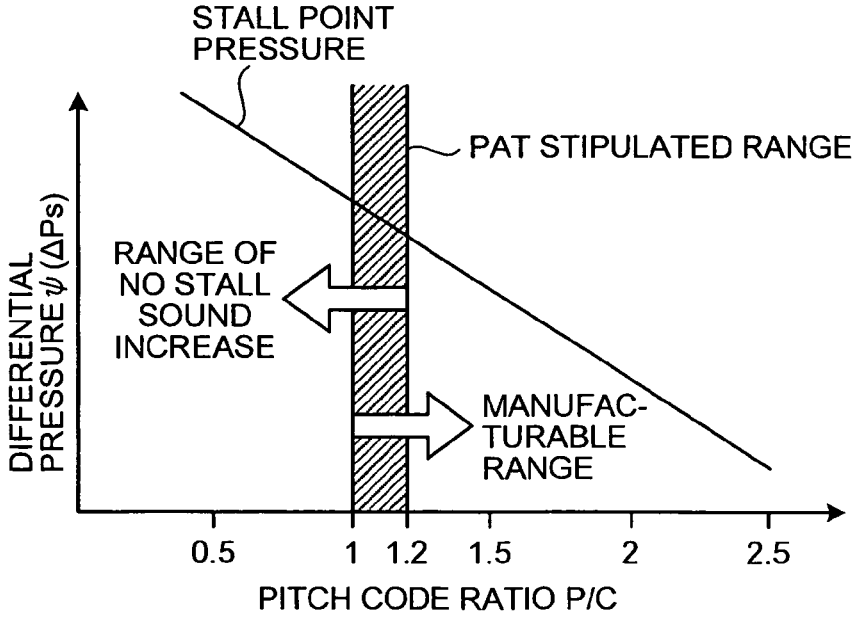
FIG. 22 is a schematic diagram showing the action of the propeller fan described in FIGS. 14 to 16.

For instance, if the pitch chord ratio P/C of the blade portion 32 becomes smaller, a stall point pressure (pressure whereby a differential pressure hardly increases even if an air volume $\phi$ is reduced) of the rotary vane wheel 13 increases (refer to FIG. 21). If the pitch chord ratio P/C is $P/C<1.0$, however, the adjacent blade portion 32 overlaps so that molding and manufacturing of the rotary vane wheel 13 made of a resin become difficult (refer to FIG. 22).

MODIFIED EXAMPLE 1

As for the propeller fan 11, it is desirable that, when a straight line m is drawn from a point S at which a chord ratio c/C at a radial outer edge of the blade portion 32 is 50(%) to the rotation center of the rotary vane wheel 13, the chord ratio c/C of an intersecting point T of the straight line m and a radial inner edge (the hub portion 31) of the blade portion 32 is in the range of $0.10 \leqq c/C \leqq 0.30$ (refer to FIG. 19). This renders a degree of forward sweeping of the rotary vane wheel 13 appropriate. Therefore, there is an advantage of further improving the noise performance, air blowing performance and air blowing efficiency of the propeller fan 11.

The chord ratio c/C is the ratio of a distance c from an front edge (edge of an rotation advance side) of the blade portion 32 to the chord length C of the blade portion 32 in a cylindrical sectional view (refer to FIG. 19) centering on the rotation center of the rotary vane wheel 13.

MODIFIED EXAMPLE 2

As for the propeller fan 11, it is desirable that a curve l on the blade portion 32 of which chord ratio c/C is 50(%) is an approximately arc of a radius R, and a ratio $R/D_F$ between the radius R of the curve l and the diameter $D_F$ of the rotary vane wheel 13 is in the range of $0.2 \leqq R/D_F \leqq 0.5$ (refer to FIG. 20). It is more desirable that the ratio $R/D_F$ is $0.3 \leqq R/D_F \leqq 0.4$ ($R/D_F \approx 0.36$). This renders the degree of forward sweeping of the rotary vane wheel 13 appropriate. Therefore, there is an advantage of further improving the noise performance, air blowing performance and air blowing efficiency of the propeller fan 11.

Figure 23:
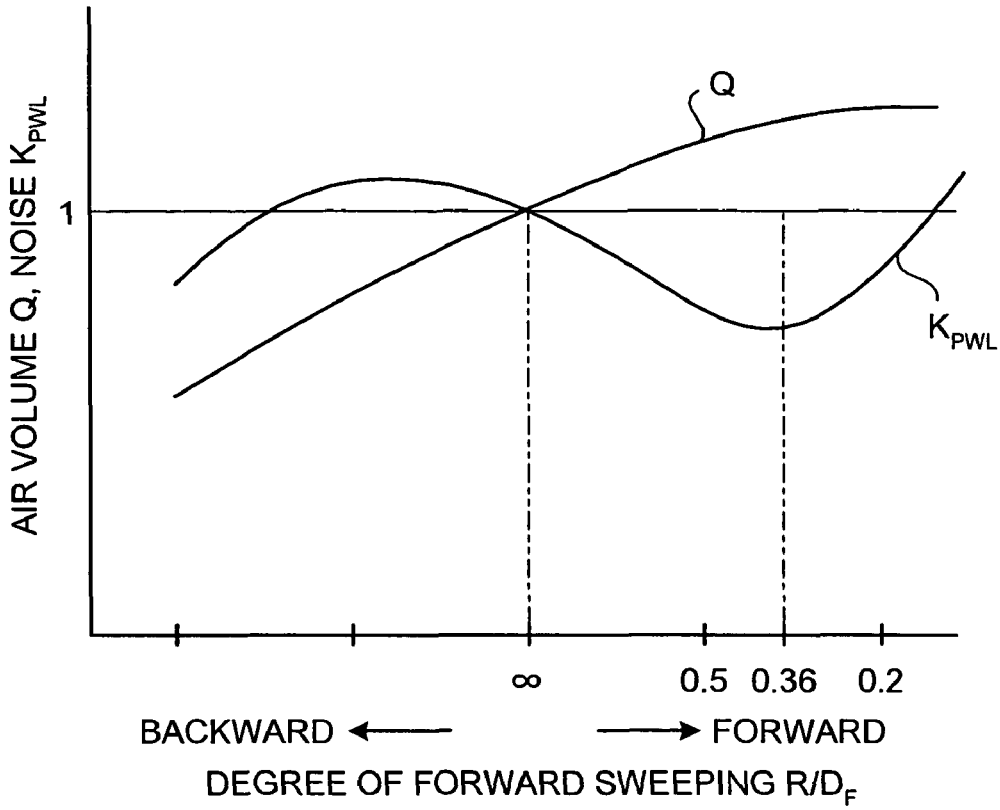
FIG. 23 is a schematic diagram showing the action of the propeller fan described in FIGS. 14 to 16.

For instance, if the degree of forward sweeping of the rotary vane wheel 13 is too low or too high, the noise performance ($K_{PWL}$) of the propeller fan 11 is degraded by the breakaway of the flow on a propeller vane plane (refer to FIG. 23).

MODIFIED EXAMPLE 3

As for the propeller fan 11, a curve l on the blade portion 32 of which chord ratio c/C is 50(%) is drawn first. Next, a circle is drawn, which has a radius r with a ratio $r/D_F$ to the diameter $D_F$ of the rotary vane wheel 13 at $0.35 \leqq r/D_F \leqq 0.5$ and is centering on the rotation center of the rotary vane wheel (refer to FIG. 20). An intersecting point of the circle and the curve l is an origin (blade portion center origin) O. A straight line passing through the origin O and the rotation center of the rotary vane wheel 13 is an axis Y. A straight line passing through the origin O and orthogonal to the axis Y is an axis X.

In this case, the curve l should desirably become an arc having its center on the axis X. To be more specific, the curve l is represented as $(X+R)^2+Y^2=R^2$ (R: radius of the curve l) in an X-Y coordinate system. This renders the degree of forward sweeping of the rotary vane wheel 13 appropriate. Therefore, there is an advantage of further improving the noise performance, air blowing performance and air blowing efficiency of the propeller fan 11.

MODIFIED EXAMPLE 4

As for the propeller fan 11, it is desirable that the number Z of the blade portions 32 formed on the rotary vane wheel 13 is 6 to 9. It is also desirable that the number Z of the blade portions 32 is an odd number (7 or 9). Such a configuration reduces the acoustic power of BPF noise in particular out of generated noise components. Thus, there is an advantage of further improving the noise performance of the propeller fan 11.

Figure 24:
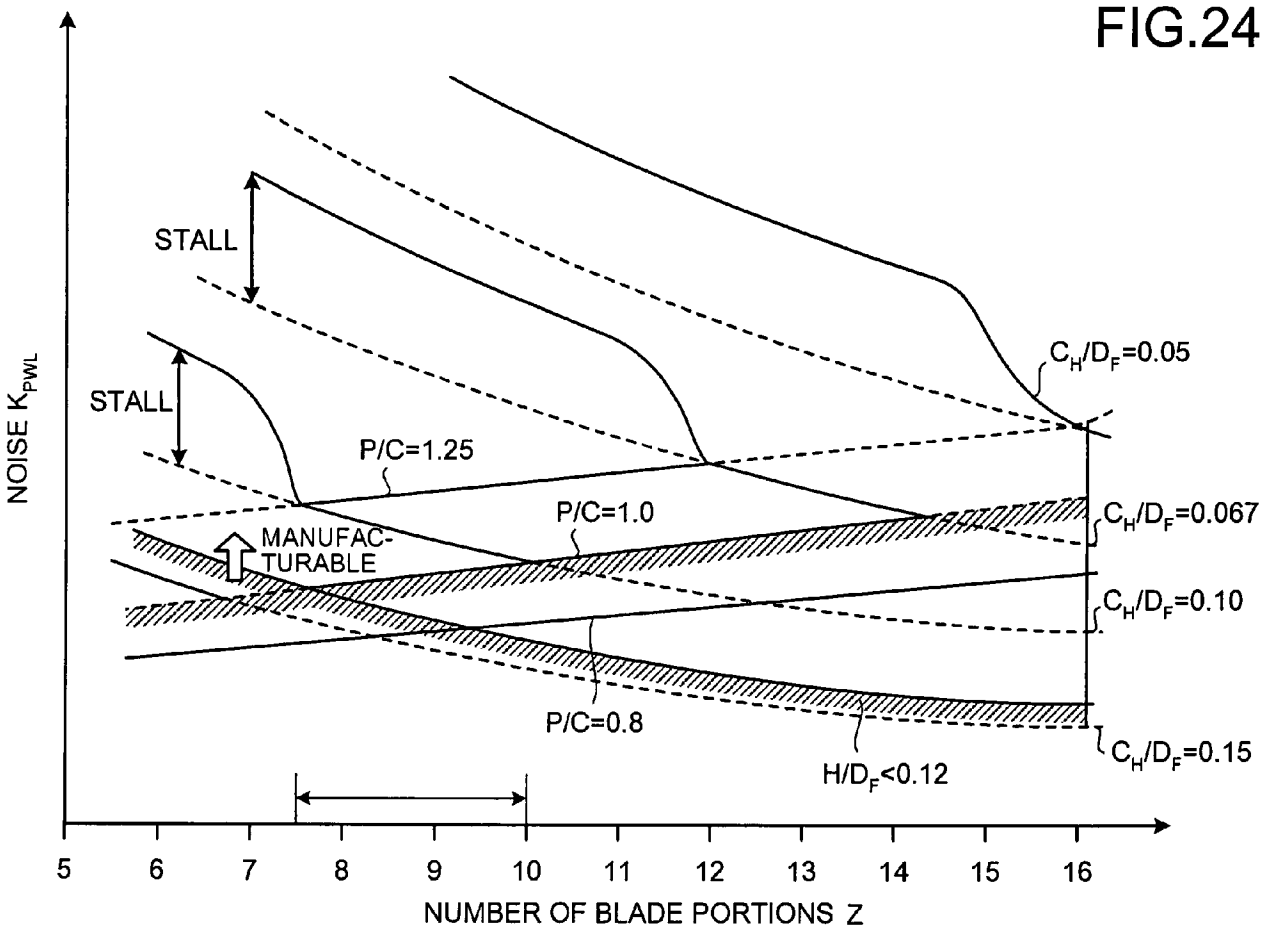
FIG. 24 is a schematic diagram showing the action of the propeller fan described in FIGS. 14 to 16.

As for the relation between the number Z of the blade portions 32 and the noise performance of the propeller fan 11, the generated noise ($K_{PWL}$) is rendered less and the rotary vane wheel 13 is less likely to stall as a ratio $C_H/D_F$ between a chord length $C_H$ of the blade portion 32 and the diameter $D_F$ of the rotary vane wheel 13 becomes larger at the hub portion 31, which is desirable (refer to FIG. 24). It is also desirable that the generated noise ($K_{PWL}$) is rendered less as the pitch chord ratio P/C becomes smaller. If the pitch chord ratio P/C is less than a predetermined value (P/C<1.0), however, the molding and manufacturing of the rotary vane wheel 13 become difficult. Therefore, the number Z of the blade portions 32 formed on the rotary vane wheel 13 is prescribed by considering these.

MODIFIED EXAMPLE 5

As for the propeller fan 11, it is possible to adopt a configuration of having a plurality of the blade portions 32 placed on the rotary vane wheel 13 at uneven pitches P. In this case, it is desirable to have the pitch chord ratio P/C prescribed based on an average of the pitches P of the blade portions 32. Such a configuration reduces the acoustic power of BPF noise in particular out of generated noise components by having the pitch chord ratio P/C appropriately prescribed. Thus, there is an advantage of further improving the noise performance of the propeller fan 11.

Third Embodiment

Figure 25:
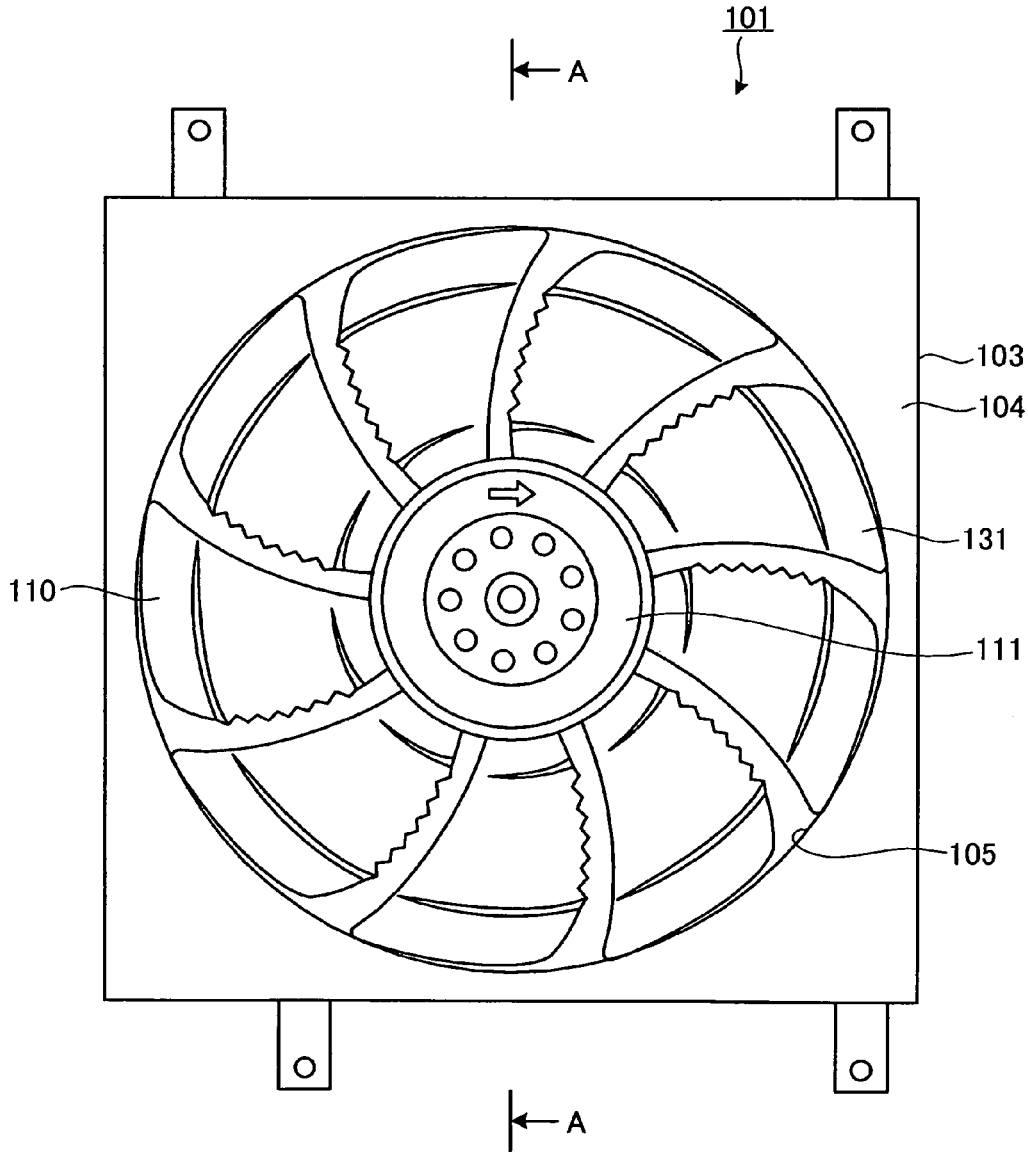
FIG. 25 is a front view of the propeller fan according to a third embodiment of the present invention.
Figure 26:
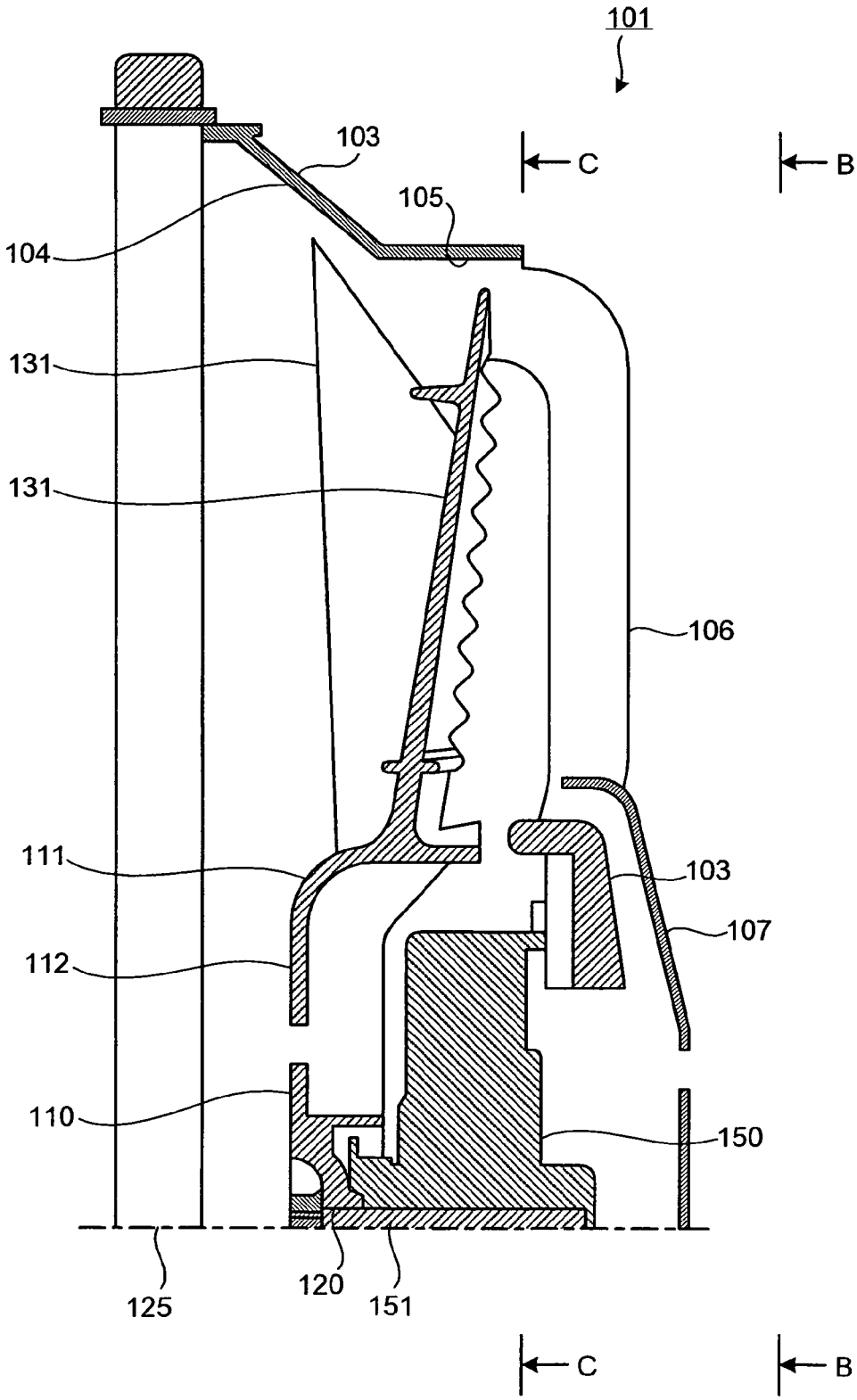
FIG. 26 is an A to A sectional view of FIG. 25.
Figure 27:
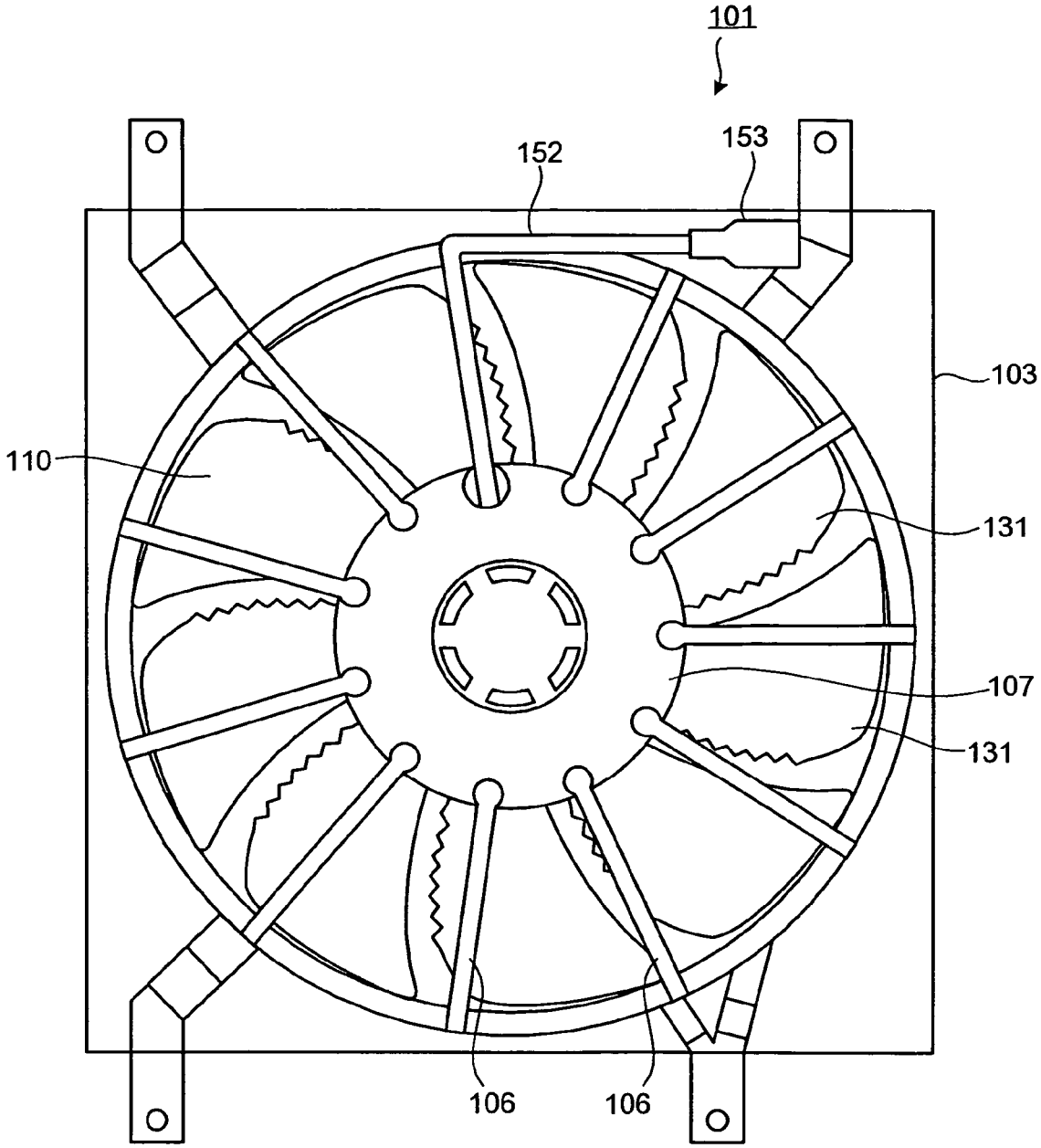
FIG. 27 is a B to B arrow view of FIG. 26.

FIG. 25 is a front view of the propeller fan according to a third embodiment of the present invention. FIG. 26 is an A to A sectional view of FIG. 25. FIG. 27 is a B to B arrow view of FIG. 26. A propeller fan 101 shown in FIGS. 25 to 27 comprises a rotary vane wheel 110 having multiple blade portions 131 provided on a hub 111 and composed of the resin and a shroud 103 which is a housing for placing the rotary vane wheel 110 therein. Of these, the shroud 103 has a channel forming surface 104 and a cylinder portion 105 formed in a cylindrical shape. The rotary vane wheel 110 is provided inside the cylinder portion 105. The rotary vane wheel 110 is rotatably supported by a motor 150 as driving means, and the motor 150 is fixed on the shroud 103.

To describe them in detail, the hub 111 has a front edge 112 formed like an approximately circular disk, and also has a connection hole 120 axially penetrating the circle of the front edge 112 at the center of the circle which is the shape of the front edge 112. The motor 150 rotatably supports the hub 111 by inserting a motor axis 151 as an axis rotating on driving the motor 150 into the connection hole 120 to connect it therewith. To be more specific, the rotary vane wheel 110 has a rotation axis 125 of the hub 111 as a central axis of the connection hole 120, and is rotatably supported by the motor 150 by centering on the rotation axis 125. The shroud 103 has multiple motor supporting portions 106 provided on one of both the edges in the axial direction of the cylinder portion 105. All the multiple motor supporting portions 106 are formed inward in the radial direction of the cylinder portion 105 from the cylinder portion 105. The motor 150 is fixed on the motor supporting portions 106 and thereby fixed on the shroud 103. The motor 150 has an electric cord 152 for conveying electricity from a power supply (not shown) connected thereto, and the electric cord 152 further has a connector 153 for connecting to another electric cord 152 provided on the edge of the opposite side to the edge on the motor 150 side thereof.

The multiple blade portions 131 provided on the hub 111 of the rotary vane wheel 110 are formed outward from the radial direction centering on the rotation axis 125. The cylinder portion 105 of the shroud 103 is formed with a radius slightly larger than the distance between an outer edge of the blade portions 131 of the rotary vane wheel 110 and the rotation axis 125. And the rotary vane wheel 110 is provided inside the cylinder portion 105 in the orientation in which a cylindrical axis (not shown) as the shape of the cylinder portion 105 and the rotation axis 125 overlap. The channel forming surface 104 is connected to the edge of the opposite side to the edge having the motor supporting portions 106 provided thereon of both the edges in the axial direction of the cylinder portion 105. As for the shape thereof, it is formed in a rectangular shape at the position apart from the cylinder portion 105 in the axial direction of the rotation axis 125 and in forms closer to circular as directed toward the cylinder portion 105.

The rotary vane wheel 110 placed in the cylinder portion 105 of the shroud 103 is in the orientation in which the front edge 112 of the hub 111 is located on the channel forming surface 104 side and the motor 150 is located on the motor supporting portion 106 side. Furthermore, a heat shield plate 107 is provided at the position further apart from the channel forming surface 104 than the motor 150 in the direction opposite to the direction in which the channel forming surface 104 is formed, that is, the direction in which the motor supporting portions 106 are provided in the axial direction of the rotation axis 125. The heat shield plate 107 is formed by a thin plate and fixed on the motor supporting portions 106.

Figure 28:
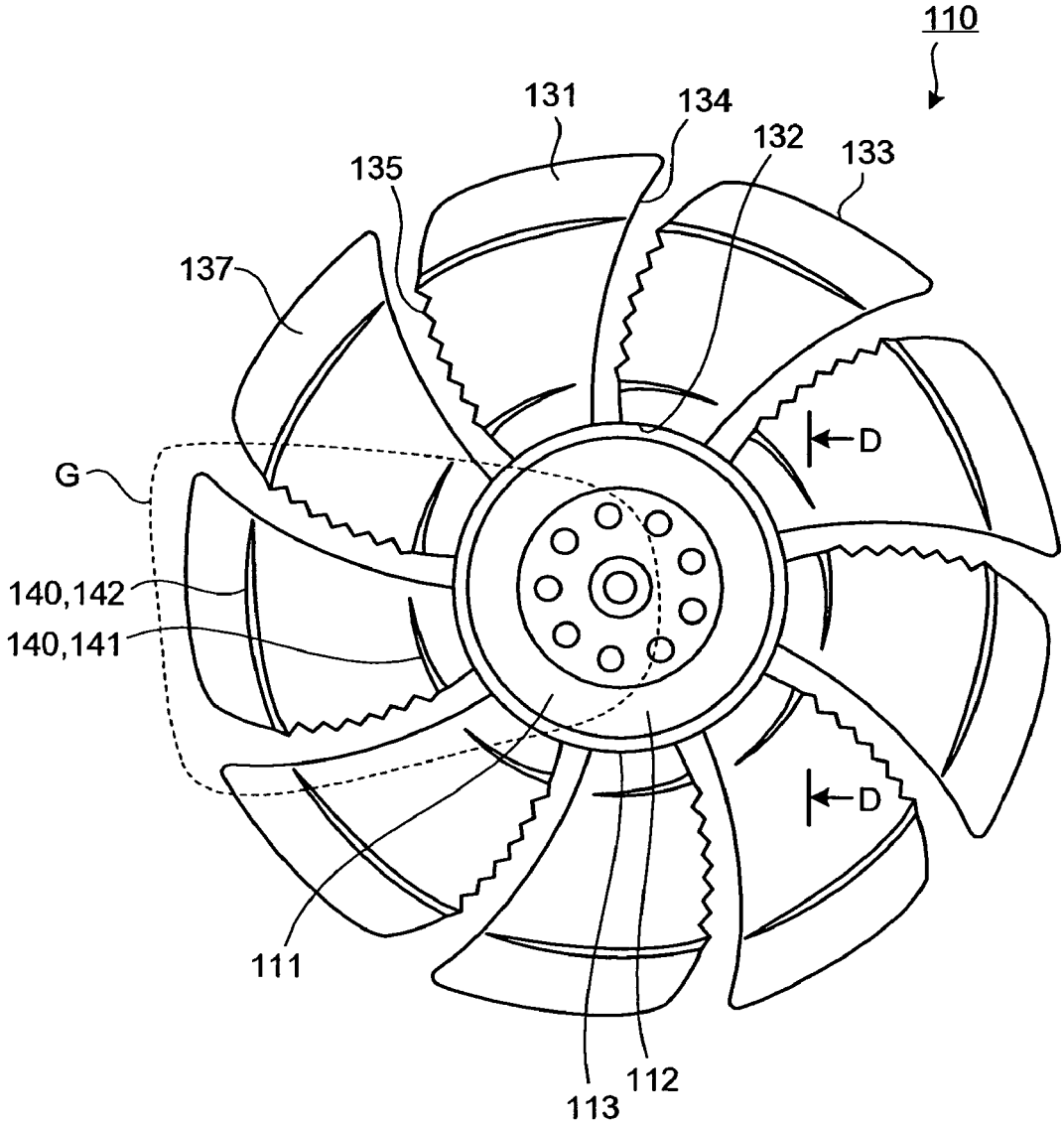
FIG. 28 is an external view of the rotary vane wheel viewed from a direction of FIG. 25.
Figure 29:
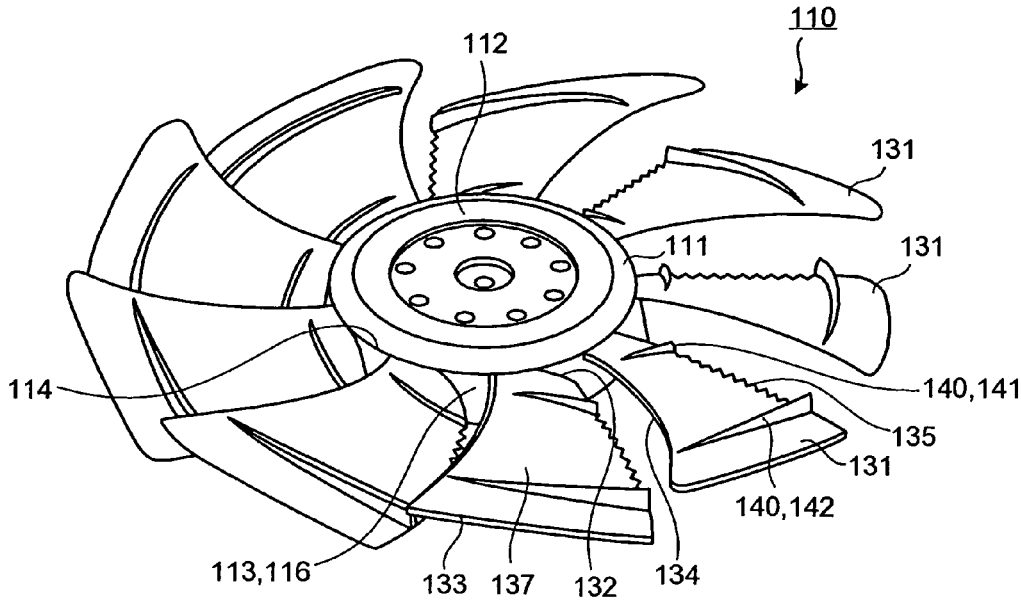
FIG. 29 is a perspective view of the rotary vane wheel viewed from a front end side of a hub.
Figure 30:
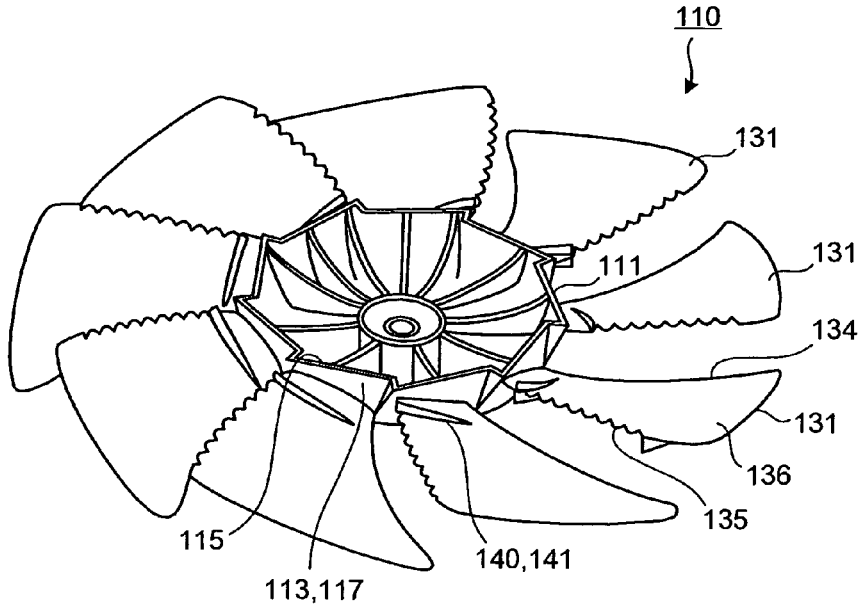
FIG. 30 is a perspective view of the rotary vane wheel viewed from an opposite direction to the rotary vane wheel of FIG. 29.

FIG. 28 is an external view of the rotary vane wheel viewed from the direction of FIG. 25. FIG. 29 is a perspective view of the rotary vane wheel viewed from the front end side of the hub. FIG. 30 is a perspective view of the rotary vane wheel viewed from the opposite direction to the rotary vane wheel of FIG. 29. The hub 111 of the rotary vane wheel 110 has an outer circumferential surface 113 provided over the entire circumference surrounding the front edge 112. The outer circumferential surface 113 is provided in one direction in the axial direction of the rotation axis 125 from the front edge 112. Of both the edges in the axial direction of the rotation axis 125 of the outer circumferential surface 113, the edge of the front edge 112 side is an upstream side end portion 114 while the edge of the opposite side to the edge of the front edge 112 side is a downstream side end portion 115. The multiple blade portions 131 are connected to the outer circumferential surface 113 by a connecting portion 132. All the blade portions 131 are formed in the same shape.

As for the multiple blade portions 131 thus formed in the same shape, the outermost edge in the radial direction centering on the rotation axis 125 is provided as a blade portion outer end portion 133. As directed from the connecting portion 132 to the blade portion outer end portion 133, the width becomes larger in the circumferential direction of the rotation axis 125 or the circumferential direction of the circle which is the shape of the front edge 112. Of both the edges of each of the blade portions 131 in the circumferential direction, one edge is a front edge 134 of the blade portion 131 while the other edge is a rear edge 135 of the blade portion 131. Of these, the front edge 134 is bending to be convex in the direction of the rear edge 135 while the rear edge 135 is bending to be convex in the direction to be apart from the front edge 134. Furthermore, the rear edge 135 is formed zigzag to be concavo-convex in the circumferential direction centering on the rotation axis 125.

The blade portions 131 are formed in the shape of plates which is the above shape if viewed in the axial direction of the rotation axis 125. And the blade portion 131 formed in the shape of a plate has two surfaces mutually oriented toward the opposite directions. Of the two surfaces, the surface positioned on the downstream side end portion 115 side of the hub 111 is an acting face 136, and the surface positioned on the upstream side end portion 114 side and on the opposite side to the acting face 136 is a negative pressure face 137.

Figure 31:
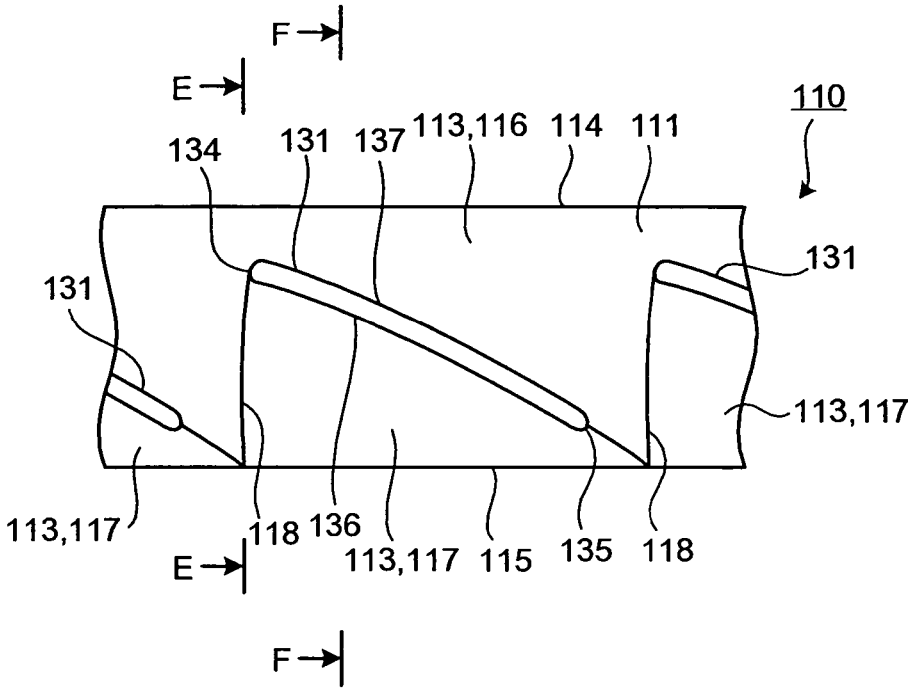
FIG. 31 is a D to D sectional view of FIG. 28.

FIG. 31 is a D to D sectional view of FIG. 28. Each of the blade portions 131 is inclined toward the circumferential direction centering on the rotation axis 125. As for the direction of the inclination, the front edge 134 is positioned close to the upstream side end portion 114, and the rear edge 135 is positioned close to the downstream side end portion 115. For this reason, each of the blade portions 131 is inclined toward the circumferential direction to shift from the upstream side end portion 114 side to the downstream side end portion 115 side as directed from the front edge 134 to the rear edge 135. Thus, the acting face 136 faces another blade portion 131 on the front edge 134 side while the negative pressure face 137 faces another blade portion 131 on the rear edge 135 side.

The outer circumferential surface 113 of the hub 111 has an inclined portion 116 and a parallel portion 117. Of these, the parallel portion 117 is formed between the connecting portion 132 of the blade portion 131 and the downstream side end portion 115. As for the end portion of the front edge 134 side of the blade portion 131 of the parallel portion 117, the position in the circumferential direction centering on the rotation axis 125 is almost at the same position as the position of the front edge 134. To be more specific, the end portion of the front edge 134 side of the parallel portion 117 is formed toward the direction of the downstream side end portion 115 from the front edge 134 along the axial direction of the rotation axis 125. The rear edge 135 side of the blade portion 131 of the parallel portion 117 is formed from the rear edge 135 to the downstream side end portion 115 almost at the same angle as the angle of gradient of the connecting portion 132 of the blade portion 131 inclined toward the circumferential direction centering on the rotation axis 125. To be more specific, the parallel portion 117 is formed in a shape of an approximately right triangle where the downstream side end portion 115 and the end portion of the front edge 134 side are orthogonal and a portion continuously formed from the front edge 134 to the downstream side end portion 115 through the rear edge 135 is a hypotenuse. The inclined portion 116 is formed around the parallel portion 117.

Figure 32:
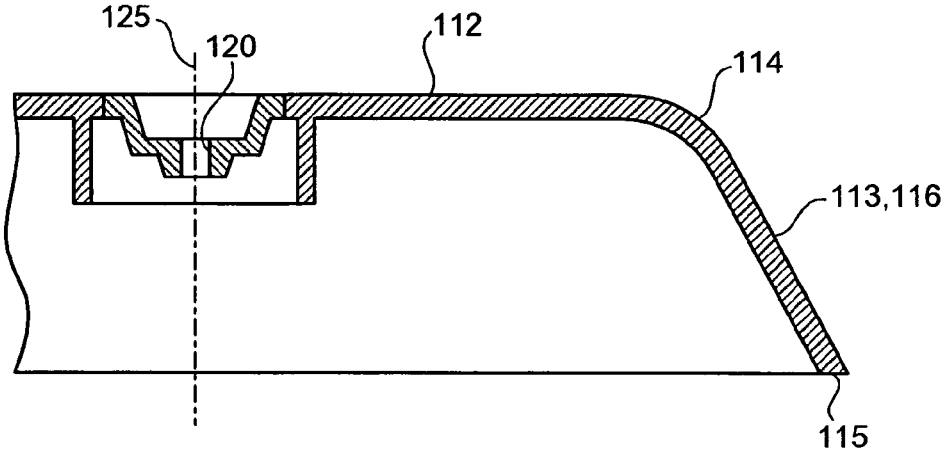
FIG. 32 is an E to E sectional view of FIG. 31.
Figure 33:
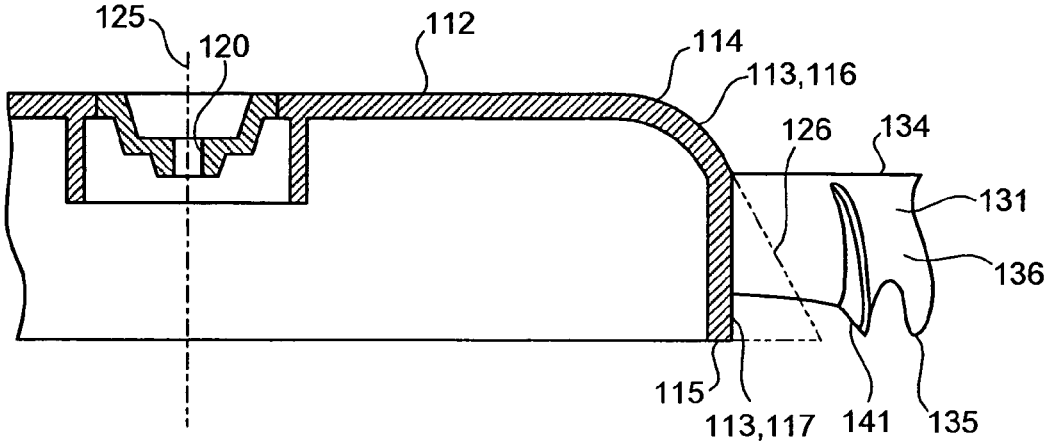
FIG. 33 is an F to F sectional view of FIG. 31.

FIG. 32 is an E to E sectional view of FIG. 31. FIG. 33 is an F to F sectional view of FIG. 31. The inclined portion 116 as a part of the outer circumferential surface 113 of the hub 111 is inclined toward the rotation axis 125 in the direction to be apart from the rotation axis 125 as directed from the upstream side end portion 114 to the downstream side end portion 115. To be more specific, the inclined portion 116 is in the shape of a part of a cone. The parallel portion 117 is formed from the connecting portion 132 as a part connecting the blade portion 131 with the outer circumferential surface 113 of the hub 111 to the downstream side end portion 115 so as to be a plane formed along the rotation axis 125. The parallel portion 117 is located more inward in the radial direction of the rotation axis 125 than an extended inclined portion 126 which is a virtual extended portion of the inclined portion 116 continued from the inclined portion 116. To be more specific, the extended inclined portion 126 is a virtual portion in the case of having the inclined portion 116 provided in the part where the parallel portion 117 is provided. The parallel portion 117 is formed more inward in the radial direction of the rotation axis 125 than the extended inclined portion 126 which is the virtual inclined portion 116.

The parallel portion 117 is formed further on the downstream side end portion 115 side than the connecting portion 132 of the blade portion 131, that is, on the acting face 136 side. And the inclined portion 116 is formed further on the upstream side end portion 114 side than the connecting portion 132 so that the inclined portion 116 is formed on the negative pressure face 137 side. For this reason, the shape of the connecting portion 132 on the acting face 136 side is the shape along the parallel portion 117, and its shape on the negative pressure face 137 side is the shape along the inclined portion 116. Here, the blade portion 131 is inclined from the upstream side end portion 114 side toward the downstream side end portion 115 side as directed from the front edge 134 to the rear edge 135. And the inclined portion 116 is inclined toward the rotation axis 125 in the direction to be apart from the rotation axis 125 as directed from the upstream side end portion 114 toward the direction of the downstream side end portion 115. Furthermore, the shape of the negative pressure face 137 side is the shape along the inclined portion 116, and so the connecting portion 132 is apart from the rotation axis 125 as directed from the front edge 134 to the rear edge 135. For this reason, the length of the negative pressure face 137 in the radial direction centering on the rotation axis 125 becomes shorter as directed from the front edge 134 to the rear edge 135.

Figure 34:
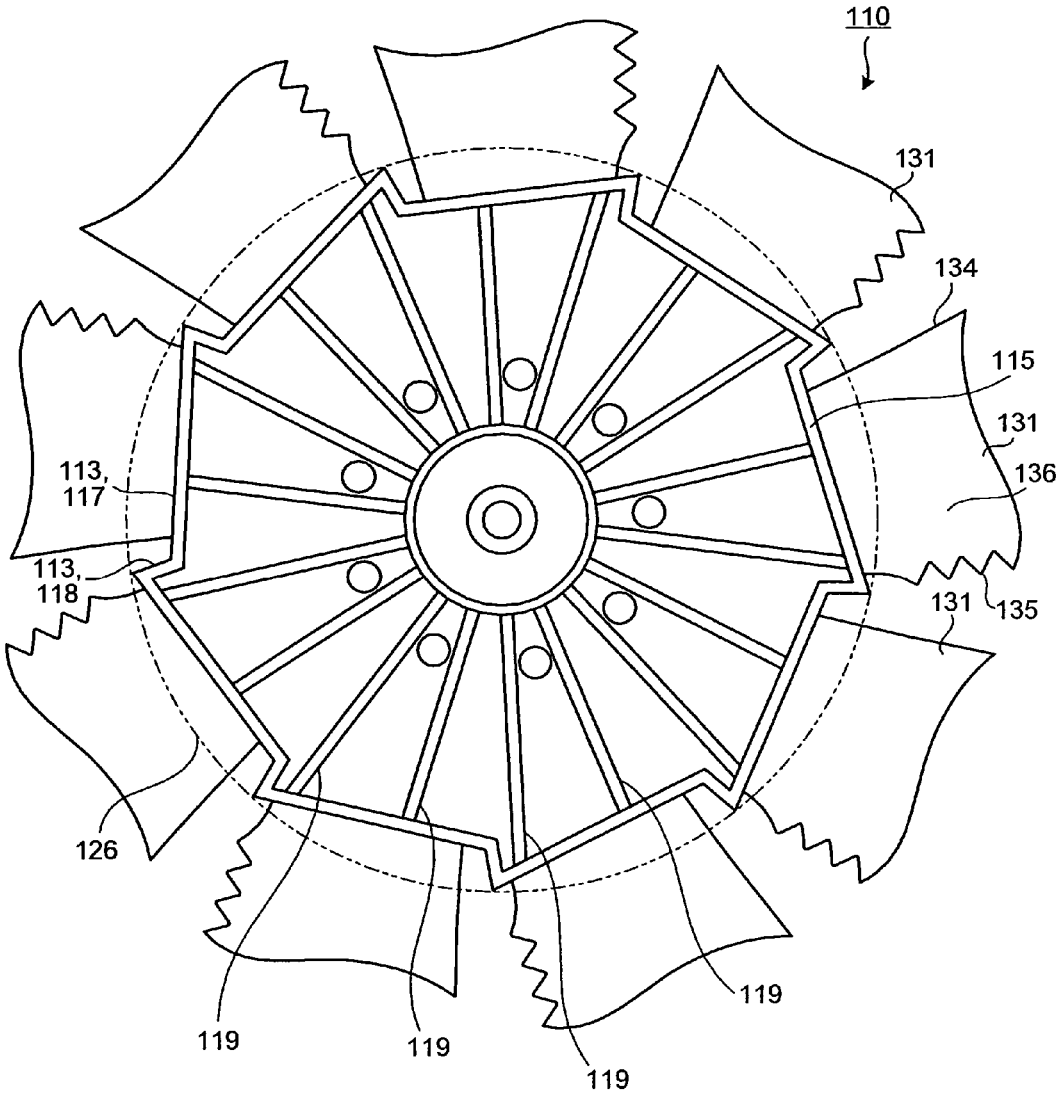
FIG. 34 is a C to C arrow view of FIG. 26, which is a relevant part detail view of the rotary vane wheel.

FIG. 34 is a C to C arrow view of FIG. 26, which is a relevant part detail view of the rotary vane wheel. As for the parallel portion 117, the end portion of the side having the front edge 134 located thereon of the blade portion 131 and the inclined portion 116 adjacent thereto further in the circumferential direction centering on the rotation axis 125 than the end portion are at different positions in the radial direction centering on the rotation axis 125, where there is a step between the parallel portion 117 and the inclined portion 116 in this part. For this reason, the parallel portion 117 and the inclined portion 116 in this part are connected by a step portion 118 formed along the radial direction of the rotation axis 125. As for the parallel portion 117, at the position of the downstream side end portion 115, the end portion other than that of the step portion 118 in the circumferential direction is almost at the same position in the radial direction centering on the rotation axis 125 as the position of the inclined portion 116 in the radial direction. The step portion 118 connects this end portion with the adjacent parallel portion 117. For this reason, at the position of the downstream side end portion 115, the parallel portion 117 has the end portion of the step portion 118 side positioned innermost in the radial direction. It is positioned more outward from the radial direction as directed apart from the step portion 118, and is connected to the adjacent parallel portion 117 by another step portion 118 at the position most distant from the step portion 118. Thus, each of the parallel portions 117 is connected to the adjacent parallel portion 117 by the step portion 118 so that the shape of the outer circumferential surface 113 is the shape like a ratchet gear when viewing the downstream side end portion 115 in the axial direction of the rotation axis 125. The hub 111 thus formed in the shape like a ratchet gear has a fixed radial thickness. Inside the hub 111, there are multiple ribs 119 shaped like plates provided.

Figure 35:
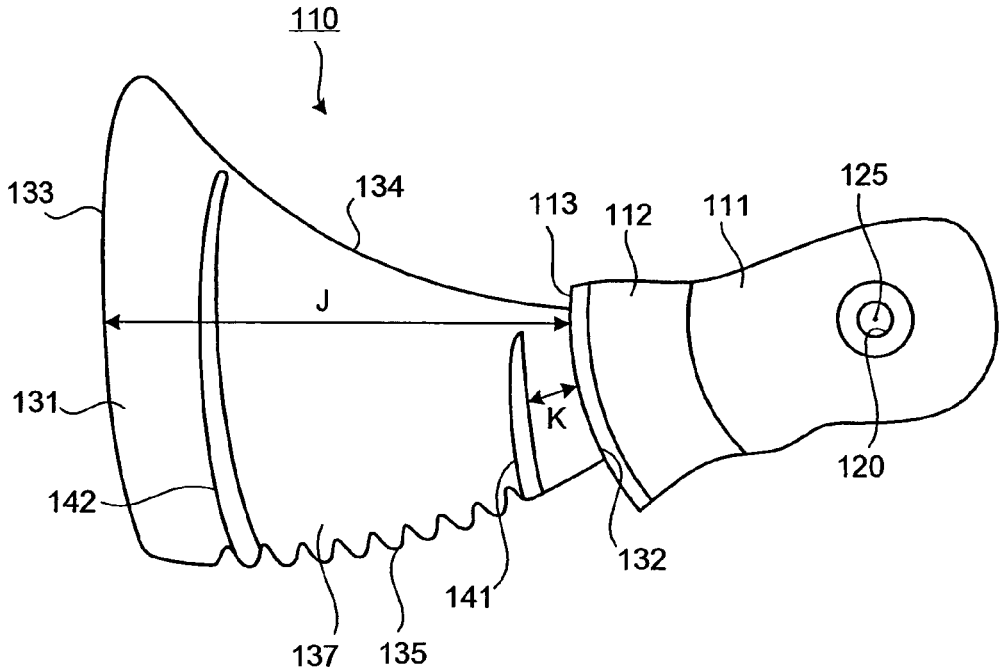
FIG. 35 is a detail view of a G portion of FIG. 28.

FIG. 35 is a detail view of a G portion of FIG. 28. The acting face 136 and the negative pressure face 137 have guide fences 140 as wall portions provided thereon. The guide fences 140 include an inner circumferential guide fence 141 and an outer circumferential guide fence 142. Of these, the inner circumferential guide fence 141 is provided in a part in proximity to the connecting portion 132 of the blade portion 131 and closer to the blade portion outer end portion 133 than the connecting portion 132 is to the blade portion outer end portion 133. The outer circumferential guide fence 142 is provided in a part in proximity to the blade portion outer end portion 133 and closer to the connecting portion 132 than the blade portion outer end portion 133 is to the connecting portion 132. Furthermore, the inner circumferential guide fences 141 are provided on both the surfaces of the acting face 136 and negative pressure face 137 while the outer circumferential guide fence 142 is provided only on the negative pressure face 137. The guide fences 140 are in the shape along the circumferential direction centering on the rotation axis 125, and are projecting from the surfaces of the blade portions 131. To be more specific, each of the guide fences 140 is formed in the shape of a plate bending along the circumferential direction centering on the rotation axis 125 from the proximity of the front edge 134 to the rear edge 135. As for height from the surfaces of the blade portions 131, it becomes higher as directed from the front edge 134 to the rear edge 135.

The inner circumferential guide fences 141 are provided on both the acting face 136 and negative pressure face 137, where the inner circumferential guide fences 141 of both the faces are almost at the same position in the radial direction centering on the rotation axis 125. If a distance J from the connecting portion 132 of the blade portion 131 to the blade portion outer end portion 133 in the radial direction centering on the rotation axis 125 is 100%, both the inner circumferential guide fence 141 on the acting face 136 side and inner circumferential guide fence 141 on the negative pressure face 137 side should desirably be provided at the positions where a distance K from the connecting portion 132 to the outward in the radial direction is in the range of 5 to 45%.

Next, a manufacturing method of the rotary vane wheel 110 will be described. The rotary vane wheel 110 is shaped by the resin, and so it is formed by injection molding or the like. To be more specific, it is formed by pouring a liquid resin into a mold (not shown) having space in the shape of the rotary vane wheel 110, filling the space with the resin and hardening the resin. This mold consists of a mold for forming the portion of the upstream side end portion 114 side in the axial direction of the rotation axis 125 and a mold for forming the portion of the downstream side end portion 115. The negative pressure face 137 side of the blade portion 131 and the inclined portion 116 of the hub 111 are formed by the mold for the upstream side end portion 114 side, and the acting face 136 side of the blade portion 131 and the parallel portion 117 of the hub 111 are formed by the mold for the downstream side end portion 115 side. When manufacturing the rotary vane wheel 110, these molds are combined, the resin is poured into the space in the shape of the rotary vane wheel 110 shaped in these molds, and these molds are removed in the axial direction if the resin gets hardened. Thus, the rotary vane wheel 110 can be taken out of the molds so as to have the rotary vane wheel 110 formed in the above-mentioned shape.

The propeller fan 101 according to the third embodiment has the above configuration. Hereunder, the actions thereof will be described. The connector 153 of the electric cord 152 connected to the motor 150 provided on the propeller fan 101 is connected to another electric cord 152 connected to the power supply so as to electrically connect the motor 150 to the power supply. And if electricity is sent to the motor 150, the motor axis 151 of the motor 150 rotates. If the motor axis 151 rotates, the hub 111 of the rotary vane wheel 110 having the connection hole 120 connected to the motor axis 151 rotates centering on the rotation axis 125. Thus, the entire rotary vane wheel 110 rotates centering on the rotation axis 125. As for the rotation direction thereof, each of the blade portions 131 of the rotary vane wheel 110 rotates in the direction toward the front edge 134 of the blade portion 131. To be more specific, the rotary vane wheel 110 rotates in the direction where the front edge 134 is located in a traveling direction of each of the blade portions 131.

If the rotary vane wheel 110 is rotated in this direction, the air hits the acting face 136 side because the blade portion 131 is inclined in such a way that the acting face 136 side faces another blade portion 131 on the front edge 134 side. Each of the blade portions 131 is inclined toward the circumferential direction to shift from the upstream side end portion 114 side to the downstream side end portion 115 side of the hub 111 as directed from the front edge 134 to the rear edge 135. Therefore, if the air hits the acting face 136 side, the air flows in the direction of the downstream side end portion 115 side of the hub 111. To be more specific, as the rotary vane wheel 110 rotates, the air flows from the front edge 134 side to the rear edge 135 side along the acting face 136 on the acting face 136 side. The air flows to the direction from the upstream side end portion 114 side to the downstream side end portion 115 side in addition to flowing from the front edge 134 side to the rear edge 135 side. If the rotary vane wheel 110 rotates, the air continuously flows as above. Therefore, on operation of the propeller fan 101, the air flows along the axial direction of the rotation axis 125 from the channel forming surface 104 side of the shroud 103 toward the direction in which the motor supporting portions 106 are provided.

As described above, the acting face 136 side of the blade portion 131 is hit by the air so that air pressure becomes high. As opposed to the acting face 136 side where air pressure becomes high, the negative pressure face 137 side has the air pressure thereon reduced because the air is pushed away by the blade portions 131 when the blade portions 131 moves in conjunction with the rotation of the rotary vane wheel 110. To be more specific, as the rotary vane wheel 110 rotates, the air flows along the negative pressure face 137 side from the front edge 134 side to the rear edge 135 side on the negative pressure face 137 side. As the negative pressure face 137 is a gently convex portion in the flow direction, a flow rate for going round the convex portion becomes faster so that the air pressure on the negative pressure face 137 side becomes lower than the air pressure on the acting face 136 side. To be more specific, the air on the negative pressure face 137 side becomes a negative pressure to the air on the acting face 136 side.

Therefore, in the case where the rotary vane wheel 110 rotates at high speed and the blade portions 131 move at high speed, it is possible to let more air flow toward the direction along the rotation axis 125 from the direction of the channel forming surface 104 to the direction of the motor supporting portions 106. In this case, however, the air pressure on the acting face 136 side becomes higher, and the air pressure on the negative pressure face 137 side becomes lower. Here, the hub 111 having the blade portions 131 connected thereto has the inclined portion 116. The air flowing along the rotation axis 125 from the upstream side end portion 114 toward the direction of the downstream side end portion 115 also flows along the inclined portion 116. However, the inclined portion 116 is inclined toward the direction to be apart from the rotation axis 125 as directed from the upstream side end portion 114 to the downstream side end portion 115. For this reason, the width of the channel of the air around the hub 111 becomes narrower as directed from the upstream side to the downstream side of the airflow. To be more specific, the channel of the air is a contracted flow channel which becomes narrower as directed from the upstream side to the downstream side.

As for the connecting portion 132 of the blade portion 131, the shape of the negative pressure face 137 side is the shape along the inclined portion 116. Furthermore, on the negative pressure face 137, channel intervals in the radial direction centering on the rotation axis 125 become narrower as directed from the front edge 134 to the rear edge 135. For this reason, the air flowing along the negative pressure face 137 has its air pressure increased while remaining attached to a vane surface as directed from the front edge 134 to the rear edge 135 so that the breakaway due to excessively lowered air pressure is prevented.

In comparison, the parallel portions 117 are formed on the acting face 136 side of the connecting portion 132 of the blade portion 131. The parallel portions 117 are located more inward in the radial direction than the extended inclined portion 126. The connecting portion 132 on the acting face 136 side is in the shape along the parallel portions 117. Therefore, the connecting portion 132 on the acting face 136 side is located more inward in the radial direction than the connecting portion 132 on the negative pressure face 137 side, and the area of the acting face 136 is larger by just that much. For this reason, it is possible to receive a larger amount of air on the acting face 136 so as to let it flow from the upstream side end portion 114 side to the downstream side end portion 115 side.

When letting the air flow from the front edge 134 to the rear edge 135 along the negative pressure face 137, the air flowing around the rear edge 135 which is formed zigzag gets disturbed a little due to the zigzag shape. To be more specific, an eddy of the air generated on the rear edge 135 is further rendered finer.

The air thus flowing along the acting face 136 and the negative pressure face 137 is rectified by the inner circumferential guide fences 141 and outer circumferential guide fences 142 formed on the surfaces thereof. To be more specific, for instance, the air flowing between the inner circumferential guide fence 141 and the connecting portion 132 keeps flowing between them from the front edge 134 to the rear edge 135.

The above propeller fan 101 has the hub 111 formed in an approximately conical shape, that is, basically as a cone, in which many portions other than the parallel portions 117 are the inclined portion 116. It is thereby possible, when letting the air flow from the upstream side end portion 114 toward the direction of the downstream side end portion 115, to form the contracted flow channel so as to prevent the air pressure from becoming too low on the negative pressure face 137 on rotation of the rotary vane wheel 110. Therefore, even in the case where the air flows at low pressure from the front edge 134 to the rear edge 135 of the negative pressure face 137, it is possible to prevent the air from breaking away due to the low pressure and also prevent the air blowing efficiency from being reduced due to occurrence of the breakaway or the noise from being generated on occurrence of the breakaway. As the parallel portion 117 is located more inward in the radial direction of the rotation axis 125 than the extended inclined portion 126, the area of the acting face 136 which is the surface of the blade portion 131 on the parallel portion 117 side is larger. Therefore, it is possible to increase the amount of air flowing on the blade portion 131. Consequently, it is possible to improve the air blowing performance and efficiency and reduce the noise.

As the rear edge 135 of the blade portion 131 is zigzag, the eddy of the air generated on the rear edge 135 is further rendered finer so as to prevent the air from breaking away significantly. Consequently, it is possible to improve the air blowing performance and efficiency and reduce the noise more securely.

As the guide fences 140 as the wall portions are provided on the surfaces of the blade portions 131, it is possible to rectify the air flowing on the surface of the blade portions 131 so as to let the air flow efficiently. The outer circumferential surface 113 is shaped by the inclined portion 116 and parallel portions 117, and so the air flowing along the outer circumferential surface 113 is apt to be disturbed. Even in the case where the airflow is disturbed, however, the disturbance of the air is blocked by the guide fences 140. To be more specific, even in the case where the disturbance of the air occurs on the outer circumferential surface 113 and this air reaches the surface of the blade portion 131 from around the connecting portion 132 of the blade portion 131 connected to the outer circumferential surface 113, the air having its flow disturbed can only flow between the guide fences 140 and the connecting portion 132 on the surface of the blade portion 131. Furthermore, as the parallel portions 117 are formed on the acting face 136 side of the blade portion 131, the air flowing along the outer circumferential surface 113 of the hub 111 is apt to be disturbed on the acting face 136 side of the blade portion 131. The guide fences 140 are also provided on the acting face 136 side of the blade portion 131. It is thereby possible to prevent the disturbed air from flowing in a wide range on the acting face 136 where the disturbed air is apt to flow. Therefore, it is possible to more securely prevent a problem such as the breakaway of the air from occurring on the entire acting face 136 where such a problem is apt to occur due to the flow of the disturbed air. Consequently, it is possible to improve the air blowing performance and efficiency and reduce the noise more securely.

As the guide fences 140 are provided on the surfaces of both the acting face 136 and the negative pressure face 137, it is possible to more securely rectify the air flowing on the surface of the blade portions 131 so as to let the air flow efficiently. There are the cases where, as the air pressure on the acting face 136 side is higher than that on the negative pressure face 137 side of the blade portion 131, the air on the acting face 136 side flows into the negative pressure face 137 side from the rear edge 135 of the blade portion 131. Even in this case, it is possible, as the guide fences 140 are provided on the surface of the negative pressure face 137, to keep the air flown in from the acting face 136 side within the range where the guide fences 140 are provided so as to prevent a disturbed flow of this air. Consequently, it is possible to improve the air blowing performance and efficiency more securely.

In the case where the air flows into the negative pressure face 137 side from the acting face 136 side, it often flows in from the rear edge 135 side so that disturbance of the air often occurs from the rear edge 135 side. However, the guide fences 140 become higher from the surface as directed from the front edge 134 to the rear edge 135. It is thereby possible, even in the case where the disturbance of the air occurs around the rear edge 135, to keep the disturbance more securely within the range where the guide fences 140 are provided so as to prevent the disturbance of the air more securely from influencing the entire blade portion 131 and causing the problem such as the breakaway of the air to the entire blade portion 131. Consequently, it is possible to improve the air blowing performance and efficiency more securely.

In the case where the distance J from the connecting portion 132 of the blade portion 131 to the blade portion outer end portion 133 in the radial direction centering on the rotation axis 125 is 100%, it is possible to provide the inner circumferential guide fences 141 to the position where the distance K from the connecting portion 132 to the outward in the radial direction is in the range of 5 to 45% so as to prevent the disturbance of the air around the connecting portion 132 from influencing the entire surface of the blade portion 131. To be more specific, it is possible to set the distance K from the connecting portion 132 to the inner circumferential guide fences 141 in the radial direction to 5% or more of the distance J from the connecting portion 132 to the blade portion outer end portion 133 so as to keep the disturbance of the air in the portion closer to the connecting portion 132 from the inner circumferential guide fences 141 more securely in the case where the air gets disturbed around the connecting portion 132. It is thereby possible to prevent the disturbance of the air having occurred around the connecting portion 132 from influencing the entire surface of the blade portion 131.

It is also possible to set the distance K from the connecting portion 132 to the inner circumferential guide fences 141 in the radial direction to 45% or less of the distance J from the connecting portion 132 to the blade portion outer end portion 133 so as to prevent the disturbance of the air from reaching the portion close to the blade portion outer end portion 133 in the case where the air gets disturbed around the connecting portion 132. It is thereby possible to prevent the range influenced by the disturbance of the air from becoming too wide and also prevent the air blowing efficiency from being reduced on the entire rotary vane wheel 110 as in the case where the range influenced by the disturbance of the air is too wide. Thus, it is possible to prevent the disturbance of the air having occurred around the connecting portion 132 from influencing the entire surface of the blade portion 131 and causing the problem such as the breakaway of the air to the entire blade portion 131. In particular, it is possible to set the range influenced by the disturbance of the air only to the portion close to the connecting portion 132. As for the blade portion 131 of the rotary vane wheel 110, the circumferential velocity is faster in the portion close to the blade portion outer end portion 133 than in the portion close to the connecting portion 132 and so air blowing action is more significant in the portion close to the blade portion outer end portion 133. However, it is possible to blow air in the portion close to the blade portion outer end portion 133 more securely by setting the range influenced by the disturbance of the air only to the portion close to the connecting portion 132. Consequently, it is possible to improve the air blowing performance and efficiency more securely.

The hub 111 of the rotary vane wheel 110 is formed basically as the cone of which diameter is larger on the downstream side end portion 115 than on the upstream side end portion 114. The parallel portion 117 parallel with the rotation axis 125 is formed from the connecting portion 132 of the blade portion 131 to the downstream side end portion 115 of the hub 111. It is thereby possible to eliminate an undercut part such as the part from the blade portion 131 to the downstream side end portion 115 in the case where the hub 111 is formed basically as the cone. To be more specific, in the case of forming the hub 111 basically as the cone and providing the blade portions 131 to the hub 111 as an integrated body and in the case of manufacturing it by resin molding, it is not possible, of the molds for shaping the rotary vane wheel 110, to remove the mold for shaping the part from the blade portions 131 to the downstream side end portion 115 in the axial direction of the rotation axis 125 after shaping the rotary vane wheel 110 because the diameter on the blade portion 131 side is smaller than that of the downstream side end portion 115. As opposed to this, the rotary vane wheel 110 has the parallel portion 117 parallel with the rotation axis 125 formed from the blade portion 131 to the downstream side end portion 115. Therefore, it is possible, after pouring the resin into the mold and having the resin hardened, to remove the mold in the direction of the rotation axis 125 easily and pull out the shaped rotary vane wheel 110 easily. Consequently, it is possible to manufacture the above-mentioned rotary vane wheel 110 with the resin easily so as to reduce cost of manufacturing.

Furthermore, the hub 111 has the fixed radial thickness. Therefore, even in the case of manufacturing the rotary vane wheel 110 by resin molding, it is possible to change the dimension on hardening the resin at a fixed ratio. Thus, a strain on hardening the resin is reduced so that accuracy can be more easily achieved. Consequently, it is possible to improve the accuracy of the rotary vane wheel 110.

As the above propeller fan 101 is provided with the above-mentioned rotary vane wheel 110, the propeller fan 101 can have the above-mentioned effects by having the rotary vane wheel 110 rotated by the motor 150 as the driving means. Consequently, it is possible to improve the air blowing performance and efficiency and reduce the noise so as to obtain the propeller fan 101 of high quality.

As mentioned above, when the air discharged by the rotary vane wheel passes the support beams, the shroud of the propeller fan has a flow of the air discharged by the rotary vane wheel changed to the direction of the rotation axis of the rotary vane wheel by the support beams. To be more specific, the support beams rectify it to reduce circling components of the flow of the air discharged by the rotary vane wheel. As the upstream side of the support beams is inclined toward the direction opposite to the rotation direction of the rotary vane wheel, the air discharged by the rotary vane wheel flows smoothly along the upstream side of the support beams and the direction of the flow is gradually changed. It is possible, by these actions, to reduce pressure interference between the rotary vane wheel and the support beams so as to prevent generation of the noise of discrete frequency components as a noise source.

The support beams become gradually thicker from the edge of the upstream side toward the edge of the downstream side, and the edge of the downstream side faces the direction parallel with the rotation axis of the rotary vane wheel. As the support beams have such a cross-section, it is possible to increase geometric moment of inertia of the support beams. It is possible to secure a sufficient cross section on the downstream side of the support beams. It is possible, by these actions, to secure sufficient strength of the rotary vane wheel in the rotation axis direction of the rotary vane wheel in particular. It is consequently possible to reduce the noise and secure the strength of the support beams supporting the rotary vane wheel and rotary vane wheel driving means even in the case of limiting the dimension in the airflow direction.

Furthermore, the support beams provided to the shroud of the propeller fan have increased inclination on the upstream side of the support beams for the plane including the rotation axis of the rotary vane wheel from the mount side toward the body portion of the shroud, that is, toward outside of a longitudinal direction of the support beams. It is thereby possible to reduce the pressure interference between the rotary vane wheel and the support beams all over the longitudinal direction of the support beams so as to prevent generation of the noise of the discrete frequency components more effectively.

The propeller fan has the diameter ratio $D_m/D_F$ between the hub portion and the blade portion and a pitch chord ratio P/C of the blade portion rendered appropriate on the rotary vane wheel having a low degree of flatness $H/D_F$ while the blade portion is a forward swept vane so as to prevent the flow on a propeller plane of the rotary vane wheel from breaking away. Thus, air blowing performance (aerodynamic performance) in a sound operational area is improved so that operation of the rotary vane wheel becomes stable. This has an advantage of improving noise performance of the propeller fan.

The propeller fan has a chord ratio c/C of the intersecting point T of the straight line m and the radial inner edge of the blade portion (hub portion) rendered appropriate when the straight line m is drawn from the point S at which the chord ratio c/C at the radial outer edge of the blade portion is 50(%) to the rotation center of the rotary vane wheel so as to render a degree of forward sweeping of the rotary vane wheel appropriate. Therefore, there is an advantage of further improving the noise performance of the propeller fan.

The propeller fan has the curve l on the blade portion of which chord ratio c/C is 50(%) as the approximate arc of a radius R, where the ratio $R/D_F$ (degree of forward sweeping) between the radius R of the curve l and the diameter $D_F$ of a rotary vane wheel 3 is rendered appropriate. Therefore, there is an advantage of further improving the noise performance of the propeller fan.

The propeller fan has the curve l as the arc having its center on the axis X, and so the degree of forward sweeping of the rotary vane wheel 3 is rendered appropriate. Therefore, there is an advantage of further improving the noise performance of the propeller fan.

The propeller fan has the number Z of the blade portions formed on the rotary vane wheel rendered appropriate, and so acoustic power of BPF noise is reduced in particular out of the generated noise components. Thus, there is an advantage of further improving the noise performance of the propeller fan.

The propeller fan has the pitch chord ratio P/C prescribed properly, and so the acoustic power of the BPF noise is reduced in particular out of the generated noise. Thus, there is an advantage of further improving the noise performance of the propeller fan.

The propeller fan has the diameter ratio $D_H/D_F$ between the hub portion and the blade portion and the pitch chord ratio P/C of the blade portion rendered appropriate on the rotary vane wheel having a low degree of flatness $H/D_F$ while the blade portion is the forward swept vane so as to prevent the flow on the propeller plane of the rotary vane wheel from breaking away. Thus, air blowing performance (aerodynamic performance) in a sound operational area is improved so that operation of the rotary vane wheel becomes stable. This has an advantage of improving the noise performance, air blowing performance and air blowing efficiency of the propeller fan.

As for the rotary vane wheel of this invention, the outer circumferential surface of the hub has the inclined portion inclined against the rotation axis of the hub in a direction to be further away from the rotation axis as directed from the upstream side edge to the downstream side edge and the parallel portion formed along the rotation axis, where the parallel portion is formed in the area from the connecting portion to the downstream side edge. To be more specific, the hub is formed in an approximately conical shape, and has the parallel portion formed only in the area from the connecting portion to the downstream side edge. It is thereby possible, when rotating the rotary vane wheel centering on the rotation axis and letting the air flow from the upstream side edge to the downstream side edge, to render width of the channel narrower as directed from the upstream side of the airflow to the downstream side. To be more specific, it is possible to form a contracted flow channel as directed from the upstream side to the downstream side so as to prevent a pressure of a negative pressure portion on the surface of the blade portion from becoming too low on rotation of the rotary vane wheel. Therefore, it is possible to prevent the air from breaking away in the negative pressure portion and also prevent the air blowing efficiency from being reduced due to breakaway or the noise from being generated on breakaway. As the parallel portion is positioned more inward in the radial direction of the rotation axis than the extended inclined portion which is the virtual extended portion of the inclined portion, it is possible to increase the area of the blade portion on the parallel portion side. It is thereby possible to increase the air volume flowing in the blade portion. Consequently, it is possible to improve the air blowing performance and efficiency and reduce the noise.

As for the rotary vane wheel, it is possible, as its rear edge is formed zigzag, to disturb the airflow slightly around the rear edge so as to prevent the air from significantly breaking away. Consequently, it is possible to improve the air blowing performance and efficiency and reduce the noise more securely.

The rotary vane wheel has the wall portion provided on the surface of the blade portion, and so it is possible to rectify the air flowing on the surface of the blade portion so as to let the air flow efficiently. Consequently, it is possible to improve the air blowing performance and efficiency more securely.

The rotary vane wheel has the wall portion provided on the surfaces of both the acting face and negative pressure face, and so it is possible to rectify the air flowing on the surface of the blade portion more securely so as to let the air flow efficiently. Consequently, it is possible to improve the air blowing performance and efficiency more securely.

The rotary vane wheel can prevent disturbance of the air around the connecting portion from exerting influence on the entire surface of the blade portion by providing the wall portion in the range. To be more specific, in the case where the distance from the connecting portion to the direction of the blade portion outer edge of the wall portion is smaller than 5% of the distance from the connecting portion to the blade portion outer edge, it is difficult to bring the disturbance of the air around the connecting portion within a portion closer to the connecting portion than the wall portion. Therefore, there is a possibility that the disturbance of the air around the connecting portion may reach the portion closer to the blade portion outer edge than the wall portion. In the case where the distance from the connecting portion to the direction of the blade portion outer edge of the wall portion is larger than 45% of the distance from the connecting portion to the blade portion outer edge, the range over which the disturbance of the air around the connecting portion exerts influence is so wide that the air blowing efficiency of the entire rotary vane wheel may be reduced and the air blowing performance may be reduced. Thus, it is possible to prevent the disturbance of the air around the connecting portion from exerting influence on the entire surface of the blade portion by setting the distance from the connecting portion to the direction of the blade portion outer edge of the wall portion within 5 to 45% of the distance from the connecting portion to the blade portion outer edge. Consequently, it is possible to improve the air blowing performance and efficiency more securely.

The propeller fan has the rotary vane wheel provided thereto, and so the propeller fan can have the above-mentioned effects by having the rotary vane wheel rotated by the driving means. Consequently, it is possible to improve the air blowing performance and efficiency and reduce the noise.

The above-mentioned rotary vane wheel has the effects of improving the air blowing performance and efficiency and reducing the noise. The above-mentioned propeller fan has the effects of improving the air blowing performance and efficiency and reducing the noise.

The embodiments of the present invention are as described above. Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A rotary vane wheel comprising:

multiple blade portions; and a hub having the multiple blade portions provided on its outer circumferential surface, wherein, in the case where, of both edges of the outer circumferential surface in an axial direction of a rotation axis of the hub, one edge is an upstream side end portion and the other edge is a downstream side end portion, the outer circumferential surface has an inclined portion inclined against the rotation axis in a direction to be further away from the rotation axis as directed from the upstream side end portion to the downstream side end portion and a parallel portion formed along the rotation axis, the parallel portion is formed between a connecting portion connecting the blade portion to the outer circumferential surface and the downstream side end portion, and positioned more inward in a radial direction of the rotation axis than an extended inclined portion which is a virtual extended portion of the inclined portion continued from the inclined portion between the connecting portion and the downstream side end portion, and a rear edge side of the parallel portion at a rear edge side of the blade portion is formed from a rear edge of the blade portion to the downstream side end portion at an angle substantially equal to an inclination angle of the connecting portion of the blade portion inclined with respect to a circumferential direction centering on the rotation axis.

2. The rotary vane wheel according to claim 1, wherein the blade portion is formed zigzag with its rear edge concavo-convex in the circumferential direction centering on the rotation axis.

3. The rotary vane wheel according to claim 1, wherein the blade portion has two surfaces mutually oriented toward opposite directions, and in the case where, of the two surfaces, the surface positioned on the downstream side end portion side is an acting face and the surface positioned on the upstream side end portion side and on the opposite side to the acting face is a negative pressure face, and the acting face has a wall portion projecting from the acting face in a shape formed along the circumferential direction centering on the rotation axis in proximity to the connecting portion.

4. The rotary vane wheel according to claim 3, wherein the negative pressure face has a wall portion projecting from the negative pressure face and formed along the circumferential direction centering on the rotation axis in proximity to the connecting portion.

5. The rotary vane wheel according to claim 3, wherein the wall portion is provided at a position at which an outward distance in the radial direction from the connecting portion is in the range of 5 to 45% in the case where the radial distance from a blade portion outer end portion which is an outermost end portion of the blade portion in the radial direction centering on the rotation axis to the connecting portion is 100%.

6. A propeller fan comprising:

a rotary vane wheel according to claim 1;

driving means for supporting the rotary vane wheel rotatably centering on the rotation axis; and a shroud for placing the rotary vane wheel therein and fixing the driving means.

* * * * *